US007238644B2

(12) United States Patent
Yukawa et al.

(10) Patent No.: US 7,238,644 B2
(45) Date of Patent: Jul. 3, 2007

(54) LAMINATE FOR PRINTING AND, PRINTING METHOD AND PRINTED MATTER USING THE SAME

(75) Inventors: Shigeo Yukawa, Wakayama (JP); Masanobu Tanaka, Wakayama (JP)

(73) Assignee: Kiwa Chemical Industry Co., Ltd., Wakayama-shi (JP)

( * ) Notice: Subject to any disclaimer, the term of this patent is extended or adjusted under 35 U.S.C. 154(b) by 176 days.

(21) Appl. No.: 10/514,114

(22) PCT Filed: May 12, 2003

(86) PCT No.: PCT/JP03/05912

§ 371 (c)(1),
(2), (4) Date: Nov. 12, 2004

(87) PCT Pub. No.: WO03/097369

PCT Pub. Date: Nov. 27, 2003

(65) Prior Publication Data

US 2005/0148469 A1 Jul. 7, 2005

(30) Foreign Application Priority Data

May 15, 2002 (JP) ..... 2002-140710

(51) Int. Cl.
*B41M 5/035* (2006.01)
*B41M 5/50* (2006.01)

(52) U.S. Cl. ..... 503/227; 428/212

(58) Field of Classification Search ..... None
See application file for complete search history.

(56) References Cited

U.S. PATENT DOCUMENTS 5,066,098 A 11/1991 Kult et al.
5,140,339 A 8/1992 Higuma et al.

(Continued)

FOREIGN PATENT DOCUMENTS

JP 55-13035 4/1980

(Continued)

OTHER PUBLICATIONS

K. W. Suh et al., Cohesive Energy Densities of Polymers from Turbidimetric Titrations, Journal of Polymer Science, Part A-1, vol. 5, pp. 1671-1681 (1967) Midland, Michigan.

(Continued)

*Primary Examiner*—Bruce H. Hess
(74) *Attorney, Agent, or Firm*—Westerman, Hattori, Daniels & Adrian, LLP

(57) ABSTRACT

A laminate for printing for coloring a resin layer by allowing a sublimable dyeing agent to permeate into the inside of the resin layer through heating, which comprises, in the order from the surface, a surface resin layer A(1) having a weak affinity with the sublimable dyeing agent and allowing the dyeing agent to pass through it and a coloring resin layer B(12) having strong affinity with the dyeing agent and preventing the transfer of the dyeing agent; and a printing method and a printed mater using the lamainate. The laminate for printing has, formed as an inner layer, a coloring resin layer having strong affinity with a sublimable dyeing agent and capable of preventing the transfer of the dyeing agent, which allows the prevention of the transfer of a sublimable dyeing agent having been printed.

27 Claims, 4 Drawing Sheets

U.S. PATENT DOCUMENTS

| | | | | |
|---|---|---|---|---|
| 5,268,349 | A * | 12/1993 | Ohno et al. | 503/227 |
| 5,342,821 | A * | 8/1994 | Pearce | 503/227 |
| 5,364,412 | A | 11/1994 | Furukawa | |
| 5,683,475 | A | 11/1997 | Furukawa | |
| 5,789,341 | A | 8/1998 | Furukawa | |
| 5,843,566 | A | 12/1998 | Miyauchi et al. | |
| 6,132,879 | A | 10/2000 | Tamura et al. | |
| 6,180,228 | B1 | 1/2001 | Mueller et al. | |
| 6,261,994 | B1 | 7/2001 | Bourdelais et al. | |
| 6,750,175 | B2 | 6/2004 | Furukawa | |
| 2002/0149658 | A1 | 10/2002 | Furukawa | |
| 2002/0155952 | A1 | 10/2002 | Furukawa | |

FOREIGN PATENT DOCUMENTS

| | | |
|---|---|---|
| JP | 6-88463 | 11/1994 |
| JP | 7-2428 | 1/1995 |
| JP | 9-1924 | 1/1997 |
| JP | 9-30108 | 2/1997 |
| JP | 9-188066 | 7/1997 |
| JP | 10-157277 | 6/1998 |
| JP | 10-202822 | 8/1998 |
| JP | 10-235992 | 9/1998 |
| JP | 11-92701 | 4/1999 |
| JP | 11-245502 | 9/1999 |
| JP | 2991357 | 10/1999 |
| JP | 11-321080 | 11/1999 |
| JP | 2999202 | 11/1999 |
| JP | 2000-127616 | 5/2000 |
| JP | 2000-335090 | 12/2000 |
| JP | 2001-71624 | 3/2001 |
| JP | 2001-71640 | 3/2001 |
| JP | 3201582 | 6/2001 |
| JP | 3206663 | 7/2001 |
| JP | 2001-334800 | 12/2001 |
| JP | 2001-347753 | 12/2001 |
| JP | 2002-14212 | 1/2002 |
| JP | 2002-79751 | 3/2003 |
| WO | WO 01/17773 | 3/2001 |
| WO | 01-708518 A1 | 9/2001 |
| WO | WO 02/02348 | 1/2002 |
| WO | WO 02/20275 | 3/2002 |

OTHER PUBLICATIONS

Chinese Office Action mailed Aug. 25, 2006, issued in corresponding Chinese Application No. 038110245.

* cited by examiner

LAMINATE FOR PRINTING AND, PRINTING METHOD AND PRINTED MATTER USING THE SAME

TECHNICAL FIELD

The present invention relates to a printing laminate that is used for sublimation dyeing in which a sublimable dye is allowed to penetrate the inside of a resin by the application of heat and relates to a printing method and a print using the printing laminate. More specifically, the present invention relates to a printing laminate that prevents the migration of a sublimable dye, which occurs during the dyeing or occurs over the course of time after the dyeing, and relates to a printing method and a print using the printing laminate.

BACKGROUND ART

Conventionally, when an image or the like is printed on a printing laminate using a sublimable dye, the printing is conducted first on paper using an ink containing the sublimable dye, and then the printed surface of the paper is applied to a surface of the printing laminate and the printed surface of the paper is brought into intimate contact with the printing laminate by means of a heat vacuum applicator, a heated roll or the like so as to conduct thermal compression for allowing the sublimable dye to penetrate the inside of the printing laminate. As another conventional method, printing is conducted using an ink containing a sublimable dye with respect to a temporary displaying surface layer, which is provided at a surface of a printing laminate in order to accept the ink, followed by heating so as to allow the dye to diffuse and penetrate inside the printing laminate, whereby a printed image to be attained can be realized. During the printing, the dye that is sublimated to have a molecular size penetrates the inside of a resin, so that an image is printed by developing colors in a colorable resin layer. In this step, however, if the transfer temperature and the transfer time are lower and shorter than the optimum conditions for the transfer printing, sufficient density of the colors cannot be obtained. Alternatively, if they are in excess of the optimum conditions, problems occur in which the sublimable dye extends to penetrate and migrate into a layer continuous with the colorable resin layer, such as a glue layer and an adhesive layer that are provided for the attachment to a substrate, which impairs the sharpness of the image or makes the edge of the image blurred. In addition, even when the printing is conducted by sublimation dyeing under the optimum conditions, the dye gradually migrates to the afore-mentioned layers that are continuous with the colorable resin layer over the course of time. This means the diffusion of the dye that is to be kept within the colorable resin layer, which causes the problems of discoloration, the blurred edge of an image and the like. As a conventional example, when a printing laminate is manufactured, a colorable resin layer, a surface resin layer and the like are laminated successively on a substrate film made of polyester, etc., so as to manufacture the printing laminate, which is proposed in JP 2002-79751 A, for example.

However, the technology of JP 2002-79751 A has the problem that, when a polyester film used is not stretched, the migration of a dye cannot be prevented. When a biaxially stretched polyester film is used, the interlayer migration of the dye can be prevented to some extent because the biaxially stretched polyester film has an enhanced crystallinity and intermolecular density of the resin due to the stretching. However, such a film also is insufficient for keeping the sharpness of an image for a long time within the colorable layer, and the edge of the printed image becomes blurred in a short time. Furthermore, when a biaxially stretched polyester film is adopted as a substrate used in the course of the manufacturing process, the biaxially stretched polyester film contracts due to the heat applied during the sublimation dyeing, which causes a problem that wrinkles and streaks occur in the printing laminate.

In addition, in the case where the biaxially stretched polyester film is to be attached on a three-dimensionally curved surface, for example, for wrapping vehicles, it becomes difficult to attach the film on the curved surface because the film lacks flexibility, elongation percentage and the like because of its stiffness. Thus, there is a demand in the market for developing a novel printing laminate used for sublimation dyeing that can keep the density of colors of an image for a long time period and can keep the sharpness of the image, is free from wrinkles and streaks that might occur during the heating for transfer and has excellent suitability for the attachment on a three-dimensionally curved surface.

DISCLOSURE OF THE INVENTION

In order to cope with the above-stated problems, it is a first object of the present invention to provide a printing laminate that can prevent the migration of a sublimable dye and to provide a printing method and a print using the printing laminate.

It is a second object of the present invention to provide a printing laminate that has flexibility for allowing the printing laminate to be attached on a curved surface and to provide a printing method and a print using the printing laminate.

In order to fulfill the above first object, a printing laminate according to the present invention, in which a sublimable dye is allowed to penetrate an inside of a resin layer by application of heat so as to color the resin layer, includes the following layers being laminated in this stated order from a surface of the laminate: a surface resin layer (A) that has weak affinity with the sublimable dye and that has a permeability of the dye; and a dye migration preventive colorable resin layer (B) that has affinity with the dye and prevents migration of the dye, or a colorable resin layer (B1) that has affinity with the dye and a dye migration preventive layer (B2) that prevents migration of the dye.

Next, in order to fulfill the above second object, a printing laminate according to the present invention includes a flexible resin layer (C) that has an elongation percentage larger than that of the dye migration preventive colorable resin layer (B), the flexible resin layer (C) being provided at a further lower layer than the dye migration preventive colorable resin layer (B).

A printing method of the present invention, by which printing is conducted with respect to a printing laminate in which a sublimable dye is allowed to penetrate an inside of a resin layer by application of heat so as to color the resin layer, the printing laminate including, a surface resin layer (A) that has weak affinity with the sublimable dye and that has a permeability of the dye; and a dye migration preventive colorable resin layer (B) that has affinity with the dye and prevents migration of the dye, which are laminated in this stated order from a surface of the laminate. The printing method includes the steps of: conducting printing with respect to a transfer paper using an ink containing a sublimable dye; and bringing an image formation face of the transfer paper in contact with the surface resin layer (A), followed by a heat treatment so as to sublimate the sublimable dye, thus allowing diffusion of the sublimable dye into the dye migration preventive colorable layer (B) or a colorable resin layer (B1) to dye the same.

A print of the present invention, with respect to which printing is conducted using a printing laminate in which a sublimable dye is allowed to penetrate an inside of a resin layer by application of heat so as to color the resin layer, the printing laminate including, a surface resin layer (A) that has weak affinity with the sublimable dye and that has a permeability of the dye; and a dye migration preventive colorable resin layer (B) that has affinity with the dye and prevents migration of the dye, which are laminated in this stated order from a surface of the laminate. The printing is conducted with respect to a transfer paper using an ink containing a sublimable dye; and an image formation face of the transfer paper is brought in contact with the surface resin layer (A), followed by a heat treatment so as to sublimate the sublimable dye, thus allowing diffusion of the sublimable dye into the dye migration preventive colorable layer (B) or a colorable resin layer (B1) to dye the same.

BEST MODE FOR CARRYING OUT THE INVENTION

Figure 1:
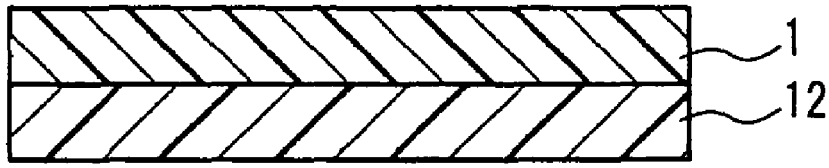
FIG. 1 is a cross-sectional view of a printing laminate according to one embodiment of the present invention.

In the present invention, a surface resin layer (A) that has weak affinity with a sublimable dye and that has a permeability of the dye; and a dye migration preventive colorable resin layer (B) that has affinity with the dye and prevents migration of the dye are included. This lamination of the surface resin layer (A) on the dye migration preventive colorable resin layer (B) allows the sublimable dye to pass through the surface resin layer (A) easily by application of heat and allows the same to penetrate the colorable resin layer (B) of the printing laminate. In addition, the dye kept in the colorable resin layer can be protected from ultraviolet rays, water and the like, thus enhancing the resistance to fading. Furthermore, the colorable resin layer has a capability of preventing the migration of the dye, which can prevent the discoloration and the blurred edge of an image, resulting from the migration of the dye to a layer that is not to be colored.

The afore-mentioned dye migration preventive colorable resin layer (B) may be formed to include separate layers of: a colorable resin layer (B1) that has affinity with the dye; and a dye migration preventive layer (B2) that prevents migration of the dye, which are laminated in this order from the surface of the laminate. The provision of the dye migration preventive layer below the colorable resin layer can prevent the discoloration and the blurred edge of an image more effectively, resulting from the migration of the dye to a lower layer that is not to be colored.

Next, a flexible resin layer (C) may be provided to have an elongation percentage larger than that of the dye migration preventive colorable resin layer (B) or the dye migration preventive layer (B2) at a further lower layer than the dye migration preventive colorable resin layer (B) or the dye migration preventive layer (B2). This configuration can prevent the generation of cracks in the dye migration preventive layer even when the printing laminate of the present invention is stretched for the attachment on a substrate having a three-dimensionally curved surface, thus avoiding the dye from migrating to other layers through the cracks. Thereby, flexibility can be given to the printing laminate, thus enabling the attachment of the printing laminate on a three-dimensionally curved substrate.

In the present invention, it is preferable that the dye migration preventive colorable resin layer (B) or the dye migration preventive layer (B2) is made of a resin containing as a main component a vinyl resin having a SP value (Solubility Parameter) of 9.0 or more. Such a use of the resin containing as a main component a vinyl resin having a SP value of 9.0 or more for the dye migration preventive layer enables more effective prevention of the dye migration.

Furthermore, when a biaxially stretched film is used as the dye migration preventive colorable resin layer (B) or the dye migration preventive layer (B2), it is preferable that the biaxially stretched film is stretched by 10% or more in a winding direction and in a width direction and that has a shrinkage ratio of 1.0% or less in the winding direction of the film at the time of heating at 150° C. for 30 minutes. Such a use of a biaxially stretched film with a low shrinkage ratio for the dye migration preventive layer can prevent wrinkles and streaks, which might occur during the sublimation dyeing.

Furthermore, it is preferable that the surface resin layer (A) is formed of a fluororesin containing a fluoroolefin copolymer that is soluble in a solvent. Such a use of the fluoroolefin copolymer that is soluble in a solvent for the surface resin layer (A) of the present invention allows the sublimable dye to penetrate efficiently the colorable resin layer within the printing laminate by application of heat, thus further enhancing the outdoor weathering resistance.

Furthermore, the surface resin layer (A) may be formed of a silicon denatured acrylic resin. Such a use of a silicon denatured acrylic resin for the surface resin layer (A) of the printing laminate allows the sublimable dye to penetrate efficiently the colorable resin layer within the printing laminate by application of heat, thus further enhancing the outdoor weathering resistance.

Furthermore, it is preferable that the dye migration preventive colorable resin layer (B) or the colorable resin layer (B1) does not contain a low molecular-weight compound of a content exceeding about 20 weight %, the low molecular-weight compound having a molecular weight of about 1,300 or less. Such a reduction of the low molecular-weight compound contained in the colorable resin layer can enhance the effect of preventing the migration of the dye.

Furthermore, a matting agent may be added to the surface resin layer (A) so as to decrease a 60° gloss (method 3 (60° relative-specular glossiness) specified by JIS Z 8741 (method for measuring relative-specular glossiness)) of the surface resin layer to 70 or less. This configuration is preferable because the reflection by light equipment such as a fluorescent lamp can be prevented.

Furthermore, it is preferable that at least one layer of the surface resin layer (A), the dye migration preventive colorable resin layer (B) and the colorable resin layer (B1) contains at least one type selected from the group consisting of an ultraviolet absorber, a light stabilizer, and an antioxidant in order to prevent the discoloration of an image and enhance the durability of the resin. The ultraviolet absorber, the light stabilizer, and the antioxidant used here preferably are a high-molecular weight type. Such a high-molecular weight type ultraviolet absorber, light stabilizer, and antioxidant can reduce: the occurrence of phase caused by the phase separation from transparent resin such as the surface layer; deficiencies such as bleed-out; and a volatilization amount during a thermal sublimation processing, thus enabling the formation of a transparent resin that is stable for a long time and enabling the prevention of an image from ultraviolet rays or the like for a long time.

Furthermore, light diffusing fine particles may be added to at least one layer of the surface resin layer (A), the dye migration preventive colorable resin layer (B), the dye migration preventive layer (B2) and each layer below these layers, so as to assign a light diffusing property to these layers. Thereby, the printing laminate can be used as a film for backlight by illuminating the printing laminate from a rear face.

Furthermore, a white pigment may be used for at least one layer of the dye migration preventive colorable resin layer (B), the colorable resin layer (B1) and the dye migration preventive layer (B2) so as to form a white layer. This configuration enhances a transmittance density of a printed image.

Furthermore, a layer including high refractive glass beads may be laminated at a lower layer of the dye migration preventive colorable resin layer (B), the dye migration preventive layer (B2) or the flexible resin layer (C) and a metal reflective layer further may be coated and formed at a lower layer of the layer including the high refractive glass beads, so as to provide a retroreflective layer. This configuration is preferable because retroreflection can be performed by the printing laminate using the illumination such as a headlight of vehicles in the nighttime, thus enhancing the visibility of the print in the nighttime, which results in significant enhancement of effects for traffic safety and advertisement.

Similarly, a layer in which high refractive glass beads are fixed and a focus resin layer may be laminated successively at lower layers of the dye migration preventive colorable resin layer (B), the dye migration preventive layer (B2) or the flexible resin layer (C), and a metal reflective layer further may be coated and formed at a lower layer of the focus resin layer, so as to provide a retroreflective layer. This configuration is preferable for the same effects as stated above.

Moreover, in a retroreflective sheet including: a plurality of transparent beads whose lower hemispheres are each provided with a metal reflective layer; a supporting resin sheet supporting the plurality of transparent beads; and a transparent cover film covering the plurality of transparent beads by being disposed on a surface side of the supporting resin sheet, a bonding portion for holding the cover film may be provided in the supporting resin sheet, and the cover film may be the afore-mentioned printing laminate. This configuration is more preferable because such a printing laminate enables much brighter retroreflection than the afore-mentioned retroreflection.

Furthermore, the surface resin layer of the afore-mentioned printing laminate may be coated with a coating formation composition including fine particles made of hydrotalcites and metal oxide, the hydrotalcites being represented by $[M^{2+}_{1-X}M^{3+}_{X}(OH)_2]^{X+}[A^{n-}_{X/n}.mH_2O]^{X-}$, wherein $M^{2+}$ denotes divalent metal ions, $M^{3+}$ denotes trivalent metal ions, $A^{n-}$ denotes anions, $0<X\leqq 0.33$, $0\leqq m\leqq 2$. This configuration is preferable, because contamination substances will not be attached thereon over a long term, thus allowing a sharp image to be displayed.

Furthermore, it is preferable that an antistatic treatment is applied to an adhesive layer provided on a rear face of the printing laminate or a releasing member such as a releasing film or a releasing paper applied to the adhesive layer or a glue layer. Such an antistatic treatment applied to the releasing member such as a releasing film or a releasing paper can prevent the instability of a printed image, caused by fluctuations in the discharge direction of an ink from a nozzle for printing, which results from the static electricity generated when the sheet is wound off or the static electricity generated by the friction between the printing laminate and a printer during the printing by an ink jet printer. Thus, a precise image can be formed.

Moreover, the printing laminate may be provided with at least one layer of peelable temporary displaying layer for enabling printing and displaying on the surface resin layer (A), and a face of the temporary displaying layer on a side that does not contact with the surface resin layer (A) may be capable of absorbing an ink containing a sublimable dye and may be capable of allowing the sublimable dye to sublimate by application of heat so as to allow diffusion and dyeing in the printing laminate, and after heating, the temporary displaying layer may be capable of being peeled off from the surface resin layer of the printing laminate while keeping a film state. This configuration is preferable because a desired image can be printed directly on the printing laminate using a sublimable dye, and the following heat treatment can realize a sharp image keeping an excellent weathering resistance easily.

According to the printing method of the present invention, the printing is conducted with respect to a transfer paper using an ink containing a sublimable dye; and an image formation face of the transfer paper is brought in contact with the surface resin layer (A), followed by a heat treatment so as to sublimate the sublimable dye, thus allowing diffusion of the sublimable dye into the dye migration preventive colorable layer (B) or a colorable resin layer (B1) to dye the same.

Furthermore, printing may be conducted with respect to at least one layer of peelable temporary displaying layer by a well-known method such as an ink jet printer, a heat transfer printer and a laser printer, and a resultant can be used as a laminate for temporary display. When the no longer needed temporary displaying layer is peeled off, a substrate on which the printing laminate of the present invention has been attached can be visually recognized, which can be used as a transparent protective film for the substrate.

Furthermore, printing may be conducted with respect to the temporary displaying layer using an ink containing a sublimable dye, followed by a heat treatment so as to allow the sublimable dye to sublimate. Thereby, a sharp image keeping high weathering resistance can be obtained.

Furthermore, preferably, the printing is conducted by an ink jet method, in particular, using an ink jet printer capable of full color printing with easiness.

Furthermore, it is preferable that a temperature of the heat treatment after printing is within a range from 150 to 200° C. This is because such a range of temperature allows the sublimation of the sublimable dye in a short time without thermal damage on a releasing film or the like on a rear face of the printing laminate, thus making the workability better.

Moreover, the printed surface preferably is dried before the heat treatment, because the diffusion of the sublimable dye can be made uniform during the heat treatment.

The following describes the printing laminate of the present invention in detail, by way of embodiments.

FIG. 1 shows a configuration of a printing laminate of the present invention. Beneath the printing laminate may be provided with a releasing paper or a releasing film that is integrated with the printing laminate via a glue layer or an adhesive layer. As a material that is available for a colorable resin layer, a synthetic resin having affinity with a dye preferably is used for capturing the sublimated and diffused dye with efficiency and for developing colors with high density. More preferably, a heat-resistant resin may be applied so as to avoid the softening considerably occurring at a heating temperature from about 150° C. to 200° C. during the sublimation dyeing and the occurrence of tuck (sticky, so-called adhesion). In particular, a resin curable with radioactive rays preferably is used. The effective forms of the radioactive rays include electron beams, ultraviolet rays, nuclear radiation, microwave radioactive rays and heat, and substances curable with the radioactive rays are well-known in the pertinent art. Furthermore, it is preferable, from the viewpoint of the protection of the dye from ultraviolet rays and the like, that an ultraviolet absorber is dispersed uniformly and included in the colorable resin layer in the amount for enabling 70% or more of ultraviolet rays to be filtered out by the colorable resin layer itself, preferably 80% or more, and more preferably 90% or more. More specifically, available materials satisfying such required properties include synthetic resins such as vinyl resins, acrylic resins, alkyd resins, polyester resins, urethane resins and epoxy resins.

Low molecular-weight compounds in the resin cause the migration of the once fixed dye gradually, which results in problems such as the blurred edge of an image. To avoid this, it is preferable to make the colorable resin layer free from the residue of the low molecular-weight compounds and to minimize the usage of an additive such as a plasticizer. To minimize the low molecular-weight compounds contained in the colorable resin layer is an effective way to keep a stable image. The afore-mentioned low molecular-weight compounds are compounds with a molecular weight of about 1300 or less, whose content is about 20 weight % or less, preferably about 15 weight % or less and more preferably about 10 weight % or less. If the low molecular-weight compounds with molecular weight of about 1300 or less are used in excess of about 20 weight %, the printed image tends to become blurred at the edge in a short time.

A printing laminate that is colored by a sublimation dyeing method may be provided with a layer of a glue or an adhesive on a rear face side of the colorable resin layer. Then, the printing laminate may be used while being attached to a substrate made of metal, wood, plastic, glass and the like, or may be used while being sandwiched between plastics. In this state, however, the dye may diffuse and migrate gradually from the colorable resin layer to the glue or the adhesive or the plastics sandwiching the laminate. As a result, problems may occur such that bleeding occurs in the image or an edge of the image becomes blurred, or the printed colors blend with each other so as to degrade the sharpness of the image.

In order to cope with these problems, an effective way is to give a capability of preventing the migration of the dye to the colorable resin layer or to provide a dye migration preventive layer that is continuous with the colorable resin layer, the migration preventive layer being for preventing the migration of the dye.

One example of preferable materials having the dye migration preventive capability or used as the dye migration preventive layer is a biaxially stretched film. In particular, a biaxially stretched film in an advanced state of crystallization and with an increased intermolecular density is preferable. Among others, a biaxially stretched film that is stretched by 10% or more in the winding direction and in the width direction, respectively, is preferable, more preferably by 50% or more, much preferably by 100% or more and particularly preferably by 200% or more. The stretching percentage less than 10% is insufficient for preventing the migration of a sublimable dye, and moreover there is still another problem that the biaxially stretched polyester film contracts due to the heat applied for allowing a sublimable dye to penetrate inside a resin to color the resin, which causes wrinkles and streaks. In order to cope with this problem, after the biaxial stretching, annealing preferably is performed to the film at a temperature of the glass transition temperature or higher, in which heat is applied so as to fix the length of the film or to allow the film to relax. The application of the film whose shrinkage ratio at the time of heating at 150° C. for 30 minutes is 1.0% or less in the winding direction of the film is preferable, more preferably, 0.8% or less and much preferably 0.6% or less. When the biaxially stretched polyester film whose shrinkage ratio exceeds 1.0% is used, the heat applied for allowing a sublimable dye to penetrate inside a resin to color the resin would cause deficiencies that impair the appearance, such as wrinkles and streaks, and therefore such a film is not preferable. In the case of the biaxially stretched polyester film, the stretching allows the orientation of polymer molecules to advance, thus increasing a degree of the crystallinity and increasing the surfaces of the polymer molecules contacting with each other in size. Conceivably, this results in an increase of the intermolecular attracting forces of the polymer, which can prevent the migration of the dye from the colorable resin layer with efficiency. However, the biaxially stretched polyester film lacks an elongation percentage because of the stiffness, and therefore when the biaxially stretched polyester film is used as the dye migration preventive layer, it is difficult to attach the film on a three-dimensionally curved surface.

Then, as a result of keen examination to accomplish the invention of a novel dye migration preventive layer that can keep a dye migration preventive capability in lieu of the biaxially stretched film, the inventors of the present invention succeeded in obtaining a dye migration preventive layer that has an excellent dye migration preventive capability by forming the dye migration preventive layer with a resin containing as a main component a vinyl resin having a SP value (Solubility Parameter) of 9.0 or more. When the migration of a sublimable dye is to be prevented using a vinyl resin, the vinyl resin with a SP value of 9.0 or more preferably is used, more preferably 9.25 or more and much preferably 9.50 or more. A resin containing these vinyl resins as main components may be used in an uncured state, or may be used with a curable substance so that they are used as a three-dimensionally structured cross-linked polymer. This configuration is preferable because it can prevent the migration of a sublimable dye.

The SP value mentioned here is a parameter indicating the polarity of a resin. A higher SP value indicates a higher polarity of the resin.

The SP value can be measured by a method described later. Herein, the SP value of vinyl copolymers can be estimated by measuring a SP value of a homopolymer of a used vinyl monomer beforehand. That is to say, the SP value of a copolymer can be estimated from the sum of the values obtained by multiplying the weight fractions of the individual vinyl monomers constituting the copolymer with the SP values of the homopolymers.

Actual measurements of SP values of typical homopolymers are as follows: methyl methacrylate=10.6, n-butyl methacrylate=8.4, ethyl methacrylate=9.5, β-hydroxy ethyl methacrylate=11.5, n-butyl acrylate=8.6 and the like.

For instance, a SP value of the copolymer including methyl methacrylate/n-butyl methacrylate/β-hydroxy ethyl methacrylate=50/40/10 (weight ratio) can be calculated as (10.6×0.5)+(8.6×0.4)+(11.5×0.1)=9.89, which is closer to the value of 9.92 obtained by the following actual measurement of the SP value of this copolymer.

A method for measuring SP values of vinyl resins is as follows:

A resin with a solid content of 0.5 g is weighed in a 100 ml Mayer flask, and 10 ml of tetrahydrofuran (THF) is added thereto so as to dissolve the resin. The dissolved solution is kept at a liquid temperature of 25° C., and hexane is dropped using a 50 ml buret while stirring with a magnetic stirrer. Then, the dropped amount ($V_h$) is determined at the time when the solution generates turbidity (turbid point).

Next, the dropped amount ($V_d$) is determined at the turbid point when deionized water is used instead of hexane.

From $V_h$, $V_d$, the SP value δ of this resin can be determined using the formula given by SUH, CLARKE [J.Polym.Sci.A-1, Vol.5,1671-1681(1967)] as follows:

$$\delta=[(V_{mh})^{(1/2)}\delta_{mh}+(V_{md})^{(1/2)}\delta_{md}]/[(V_{mh})^{(1/2)}+(V_{md})^{(1/2)}]$$

where $$V_{mh}=(V_h\cdot V_t)/(\phi_h\cdot V_t+\phi_t\cdot V_h),$$

$$V_{md}=(V_d\cdot V_t)/(\phi_d\cdot V_t+\phi_t\cdot V_d)$$

$$\delta_{mh}=\phi_h\cdot\delta_h+\phi_t\cdot\delta_t$$

$$\delta_{md}=\phi_d\cdot\delta_d+\phi_t\cdot\delta_t$$

$\phi_h$, $\phi_d$, $\phi_t$; volume fraction of hexane, deionized water and THF at turbid point $$(\phi_h=V_h/(V_h+10),\ \phi_d=V_d/(V_d+10))$$

$\delta_h$, $\delta_d$, $\delta_t$; SP values of hexane, deionized water and THF $V_h$, $V_d$, $V_t$; molecular volume of hexane, deionized water and THF (ml/mol)

Next, vinyl monomers used for synthesizing vinyl resins include: various aromatic series vinyl monomers such as styrene, α-methyl styrene, p-t-butyl styrene and vinyltoluene;

Various (meth)acrylates such as methyl(meth)acrylate, ethyl(meth)acrylate, n-propyl(meth)acrylate, i-propyl(meth)acrylate, n-butyl(meth)acrylate, i-butyl(meth)acrylate, t-butyl(meth)acrylate, 2-ethylhexyl (meth)acrylate, lauryl(meth)acrylate, cyclohexyl(meth)acrylate, benzyl (meth)acrylate, isobornyl(meth)acrylate, dibromopropyl(meth)acrylate, tribromophenyl(meth)acrylate and alkoxyalkyl(meth)acrylate;

Diesters of unsaturated dicarboxylic acid, such as maleic acid, fumaric acid and itaconic acid, and monohydric alcohol;

Various vinyl esters such as vinyl acetate, vinyl benzoate and "VEOVA" (trade name, vinyl ester produced by Japan Epoxy Resins Co., Ltd.);

(Per)fluoro alkyl group-containing vinyl esters such as "VISKOTE 8F, 8FM, 17FM, 3F or 3FM" (trade name, fluorine-containing acrylic monomer produced by Osaka Organic Chemical Industry Ltd.), perfluoro cyclohexyl (meth)acrylate, di-perfluoro cyclohexyl fumarate and N-i-propyl perfluoro octanesulfone amidoethyl(meth)acrylate, or various fluorine-containing polymerizable compounds such as vinyl ethers, (meth)acrylates and unsaturated polycarboxylic acid esters;

Vinyl monomers that have not functional groups such as olefins, such as vinyl chloride, vinylidene chloride, vinyl fluoride, vinylidene fluoride, trifluoroethylene and chlorotrifluoropropylene;

Various amide bond containing vinyl monomers such as (meth)acrylamide, dimethyl(meth)acrylamide, N-t-butyl (meth)acrylamide, N-octyl(meth)acrylamide, diacetone acrylamide, dimethyl aminopropyl acrylamide and alkoxylated N-methylolated(meth)acrylamides;

Various dialkylamino alkyl(meth)acrylates such as dimethylamino ethyl(meth)acrylate and diethylamino ethyl (meth)acrylate;

Carboxyl group-containing vinyl monomers such as (meth)acrylic acid, crotonic acid, maleic acid, fumaric acid and itaconic acid; and Hydroxyl group containing (meth)acrylates such as 2-hydroxyethyl(meth)acrylate, 2-hydroxypropyl(meth)acrylate, 3-hydroxypropyl(meth)acrylate, 2-hydroxybutyl(meth)acrylate, 3-hydroxybutyl(meth)acrylate and 4-hydroxybutyl (meth)acrylate.

Furthermore, other copolymerizable vinyl monomers include (meth)acrylonitrile, glycidyl(meth)acrylate, (β-methyl)glycidyl(meth)acrylate, allyl glycidyl ether, vinyl ethoxy silane, α-methacryloxy propyltrimethoxy silane, trimethysiloxyethyl(meth)acrylate and the like.

The vinyl resins used in the present invention can be prepared using the respective components as raw materials including vinyl monomers by a well-known polymerization (reaction) method such as a batch type, a semi-batch type or a continuous type solution polymerization method under normal pressure or under pressure. In this step, various well-known radical generative polymerization catalysts such as azobisisobutyronitrile, benzoyl peroxide, t-butyl peroxy benzoate, t-butyl peroxy-2-ethyl hexanoate, t-butyl hydroperoxide, di-t-butyl peroxide and cumene hydroperoxide can be used alone or by mixing several types depending on the polymerization condition.

As solvents used for the solution polymerization, aromatic hydrocarbons such as toluene and xylene and solvents such as ester solvents, ketone solvents and alcohol solvents may be selected as needed.

The following describes an example where preferable vinyl resins with SP values of 9.0 or more are synthesized.

REFERENCE EXAMPLE 1

1000 parts of n-butyl acetate was put in a four-necked flask equipped with a stirrer, a thermometer, an inner gas inlet and a condenser, and a temperature was increased to 100° C. Next, a mixture including: 650 parts of methyl methacrylate; 245 parts of n-butyl methacrylate; 100 parts of 2-hydroxy ethyl methacrylate; 5 parts of methacrylic acid; and 15 parts of t-butyl peroxy-2-ethyl hexanoate was dropped at 110° C. over 4 hours, and even after the dropping, the temperature was kept at 110° C. so as to continue the reaction for 6 hours, whereby vinyl copolymer (a-1) having about a nonvolatile content of 50% was obtained. This vinyl copolymer (a-1) was dried and its SP value was measured. The measurement result was 10.16.

REFERENCE EXAMPLES 2 TO 6

Vinyl copolymers (a-2) to (a-6) were obtained in a similar manner to Reference Example 1 except that the ratio of vinyl monomers was changed as in Table 1. Furthermore, they were dried and their SP values were measured. The measurement results are shown in Table 1.

TABLE 1

| Vinyl monomers | a-2 | a-3 | a-4 | a-5 | a-6 |
|---|---|---|---|---|---|
| styrene | 100 | 200 | | 200 | |
| methyl methacrylate | 200 | 500 | 800 | | 400 |
| ethyl methacrylate | 200 | | | 450 | |
| ethyl acrylate | | | 190 | | 100 |
| n-butyl methacrylate | 100 | 200 | | | 300 |
| t-butyl methacrylate | | | | 200 | |
| n-butyl acrylate | 195 | 95 | | 150 | 190 |
| 2-hydroxy ethyl methacrylate | 200 | | | | |
| methacrylic acid | 5 | 5 | 10 | | 10 |
| S P values | 9.79 | 9.64 | 10.49 | 9.02 | 9.54 |

When the afore-mentioned substances having the SP values of 9.0 or more are used as a dye migration preventive layer, the film thickness preferably is set from 1 μm to 100 μm, inclusive, more preferably from 2 μm to 80 μm, inclusive and still preferably from 3 μm to 60 μm, inclusive. A thickness less than 1 μm leads to insufficient effects for preventing the migration of the dye, and a thickness exceeding 100 μm makes the film strength too high, thus degrading the suitability for attachment on a three-dimensional curved surface, so that such a thickness is not preferable. Moreover, the cost also is increased, and such a thickness is not preferable from that respect also. Furthermore, when a glass transition temperature (Tg) of the afore-mentioned substances having the SP values of 9.0 or more applied to the dye migration preventive layer is set at 60° C. or higher, preferably at 70° C. or higher and still preferably at 80° C. or higher, the molecular movement can be frozen even at high temperatures such as in the operation in the midsummer open air, and therefore such a configuration is more preferable.

As other effective forms of the dye migration preventive layer, a metal thin layer may be formed to be continuous with a colorable resin layer or to be continuous further with the dye migration preventive layer, which prevents the migration of the dye. This configuration, however, is not preferable in the case where a retroreflective layer is formed at a bottom layer. Herein, the metal layer may be formed of the below-described metals. Although its thickness may vary depending on the metal used, the thickness may be from 5 to 500 nm, preferably from 10 to 400 nm and still preferably from 20 to 300 nm. The thickness of the afore-mentioned metal layer less than 5 nm cannot achieve the objective as the dye migration preventive layer, because the screening capability of the metal layer is not sufficient. Additionally, since the metal layer has to be stretched when the printing laminate is attached on a curved surface, the thickness of the metal layer further is decreased, thus worsening the condition. The thickness exceeding 500 nm, inversely, may degrade the adhesion of the metal layer with the colorable resin layer or the dye migration preventive layer, or cracks may tend to occur in the metal layer, and the cost also is increased, and therefore such a thickness is not preferable. A method for providing the afore-mentioned metal layer is not limited especially, and general methods such as evaporation, sputtering, transferring and a plasma method are available. Among them, evaporation and sputtering are preferably used in terms of the workability. When the metal used for forming the metal layer also is not limited especially, metals such as aluminum, gold, silver, copper, nickel, chrome, magnesium and zinc are available. Among them, in terms of the workability and the easiness of the formation the metal layer, aluminum, chrome and nickel are particularly preferable. The above metal layer may be formed of an alloy including two or more kinds of metals.

The provision of a surface resin layer on the colorable resin layer of the printing laminate of the present invention enables the protection of the dye in the colorable resin layer against ultraviolet rays, water and the like, thus allowing the sufficient durability in the open air to be kept. Materials that can satisfy such required properties include olefin resins, i.e., polyethylene, polypropylene and the like, vinyl alcohol resins, i.e., polyvinyl alcohol and ethylene-vinyl alcohol copolymer resins, fluorine resins, silicon resins or a mixture of them and the like.

Among them, synthetic resins containing fluorine resins and silicon denatured acrylic resins as main components, which have excellent outdoor weathering resistance and rich non-affinity with the dye, are used preferably. The synthetic resins containing fluorine resins as a main component include fluorine resins such as polytetrafluoroethylene, tetrafluoroethylene-perfluoro alkylvinylether copolymer, tetrafluoroethylene-hexafluoropropylene copolymer, tetrafluoroethylene-hexafluoropropylene-perfluoro alkylvinylether copolymer, tetrafluoroethylene-ethylene copolymer, polychlorotrifluoroethylene, chlorotrifluoroethylene-ethylene copolymer, polyvinylidene fluoride and polyvinyl fluoride. In order to process these fluorine resins, a generally adopted method is to let the resins melt mainly by the application of heat and to process the resins in a desired shape, followed by cooling so as to form an article. However, the film produced by such a method is stretched in the longitudinal direction and in the lateral direction, and therefore when the temperature of the film is increased to 150 to 200° C. during the thermal transferring, the film tends to contract, thus increasing the tendency of occurring deficiencies such as blurring in printing and the lack of sharpness in printed pattern. In order to avoid the deficiencies, the surface resin layer preferably is formed of a not-stretched fluorine resin film that is manufactured by a processing method such as solvent casting (casting) of a fluorine resin made of fluoroolefin copolymer that is soluble in the afore-mentioned solvents. More preferably, the surface resin layer is formed by a reaction of a fluoroolefin copolymer that is soluble in a solvent having a reactive functional group with a hardener and/or a catalytic hardener that react with this reactive functional group. Among them, in terms of the workability for manufacturing the film, copolymers of fluoroolefins or copolymers of fluoroolefins and a monomer other than the fluoroolefins are particularly preferable because they have good solubility with respect to general-purpose solvents (hereinafter, they are also referred to as "fluoroolefin copolymers"). Specific examples of fluoroolefins used for preparing such fluoroolefin copolymers include: vinyl fluoride; vinylidene fluoride, trifluoroethylene, tetrafluoroethylene, chlorotrifluoroethylene, hexafluoropropylene and the like. The copolymerization of two or more kinds of these fluoroolefins allows a copolymer containing fluoroolefins only as a monomer component to be obtained. Furthermore, the copolymerization of the afore-mentioned fluoroolefins with monomers that are capable of the copolymerization with them allows the preparation of a fluoroolefin copolymer that is soluble in a solvent. Specific examples of vinyl copolymers that are capable of the copolymerization with the fluoroolefins include: alkyl or cycloalkyl vinyl ethers such as methyl vinyl ether, ethyl vinyl ether, n-butyl vinyl ether, cyclohexyl vinyl ether and cyclopentyl vinyl ether; vinyl carboxylate esters such as vinyl acetate, vinyl propionate, vinyl butyrate, vinyl pivalate, vinyl versatate, vinyl benzoate, p-t-butyl vinyl benzoate, cyclohexane vinyl carboxylate and isopropenyl acetate; monomers containing a hydroxyl group such as 2-hydroxy ethyl vinyl ether, 3-hydroxy propyl vinyl ether, 4-hydroxy butyl vinyl ether, 2-hydroxy ethyl allyl ether and 2-hydroxy ethyl(meth)acrylate; monomers containing a carboxyl group such as acrylic acid and methacrylic acid; monomers containing an amino group such as N,N-dimethylamino ethyl(meth)acrylate and N,N-dimethylamino ethyl vinyl ether; monomers containing an epoxy group such as glycidyl vinyl ethers and glycidyl (meth)acrylate; monomers containing a hydrolyzable silyl group such as trimethoxy vinyl silane, triethoxy vinyl silane, 2-trimethoxy ethyl vinyl ether, γ-methacryloxy propyl trimethoxy silane; vinyl monomers containing a silyloxy group such as 2-trimethylsilyloxy ethyl vinyl ether and 4-trimethylsilyloxy butyl vinyl ether; monomers containing silyloxy carbonyl group such as trimethyl silyl(meth)acrylate, vinyl-5-trimethyl silyloxy carbonyl pentanoate, in addition to ethylene, propylene, vinyl chloride and various alkyl(meth)acrylates. Among these monomers, in terms of copolymerizing properties and coating properties, etc., the use of vinyl ester and vinyl ether without a functional group is preferable as an essential component. If required, the above-described monomers having a reactive functional group may be copolymerized.

A preferable copolymer of fluoroolefins and a monomer other than fluoroolefins that is used for the present invention is obtained by copolymerizing about 15 to 70 weight % of fluoroolefin, about 0 to 30 weight % of vinyl monomer containing a reactive functional group and about 5 to 85 weight % of another monomer that can be copolymerized with them. A more preferable copolymer is obtained by copolymerizing about 20 to 65 weight % of fluoroolefin, about 5 to 25 weight % of vinyl monomer containing a reactive functional group and about 10 to 75 weight % of another monomer that can be co-polymerized with them. In the case of the usage of fluoroolefin less than about 15 weight %, the durability, the antifouling effects and the permeability of the sublimable dye become insufficient, whereas in the case of the usage exceeding about 70 weight %, the solubility into general-purpose solvents would deteriorate, thus degrading the workability, and therefore such usage is not preferable. As for the weight-average molecular weight of the copolymer used, in terms of the workability and the durability of the film, a preferable range is about 5,000 to 400,000 and a more preferable range is about 7,000 to 300,000.

The fluorine resin that is the surface resin layer of the printing laminate of the present invention can be prepared using a fluoroolefin copolymer and an acrylic polymer as described above. The acrylic polymer mentioned here is a homopolymer or a copolymer whose essential component is acrylic ester or metaacrylic ester, and those with or without the above-described reactive functional group may be available. Although various known polymers are available as this acrylic polymer, in terms of the durability and the workability, it is preferable to use the polymer with a weight-average molecular weight of about 5,000 to 400,000 and more preferably about 7,000 to 300,000.

When the afore-mentioned fluoroolefin copolymer and acrylic polymer are used concurrently as the resin for the surface resin layer, the ratio by weight between the former and the latter is preferably in the range of about 30:70 to about 98:2 and more preferably in the range of about 40:60 to about 95:5. In the case of the usage of the acrylic polymer less than about 2%, the properties of the acrylic polymer to be assigned would not be exerted sufficiently, whereas in the case of the usage exceeding about 70 weight %, the durability, the antifouling effects and the permeability of the sublimable dye would become insufficient, and therefore such usage is not preferable.

When forming the surface resin layer of the printing laminate of the present invention, the fluoroolefin copolymer and the acrylic polymer are used in a state where they are dissolved in an organic solvent. In the case that the fluoroolefin copolymer or the acrylic polymer that is mixed therewith has a reactive functional group as described above, a material having a functional group that can react with the above-stated reactive functional group may be mixed therewith as a hardening agent. In the case of having a silyl group with hydrolyzability as the reactive functional group, a catalytic hardener made of acids, basic or various organic tin compounds may be mixed therewith. In addition, also in the case that the hardening agent is mixed as described above, a catalyst suitable for promoting the hardening reaction may be added. As the hardening agent, in the case that the reactive functional group of the fluoroolefin copolymer is a hydroxyl group or a silyloxy group, polyisocyanate, block polyisocyanate, amino resin, metalalkoxide, metal chelate compounds or the like can be mixed. In the case that the reactive functional group is an epoxy group, polycarboxy compounds, polysilyloxycarbonyl compounds, polyamine compounds or the like can be mixed. In the case that the reactive functional group is a carboxyl group or a silyloxycarbonyl group, polyepoxy compounds, epoxysilane compounds, metal chelate compounds or the like can be mixed. In the case that the reactive functional group is an amino group, polyepoxy compounds or epoxysilane compounds can be mixed as the hardening agent. When an amino resin is mixed as the hardening agent with the fluoroolefin copolymer or the mixture of a fluoroolefin copolymer and an acrylic polymer, about 5 to 100 parts by weight of amino resin, more preferably about 10 to 60 parts by weight, is preferably mixed with about 100 parts by weight of the above-described base resin component.

In the case where a hardening agent other than the amino resin is mixed, the hardening agent is mixed so that the functional group of the hardening agent constitutes preferably about 0.2 to 2.5 equivalent weight and more preferably about 0.5 to 1.5 equivalent weight with respect to 1 equivalent weight of the reactive functional group in the fluoroolefin copolymer or the mixture of the fluoroolefin copolymer and the acrylic polymer.

In the compositions used for forming the afore-mentioned surface resin layer, fine particles of silica, calcium carbonate, aluminum hydroxide, acrylic resin, organic silicone resin, polystyrene, urea resin, formaldehyde condensate and the like may be added as a matting agent so as to decrease the 60° gloss of the surface to 70 or less, whereby the reflection of light equipment such as a fluorescent lamp on the surface layer can be prevented. The use of acrylic resin is preferable because the compatibility with the afore-mentioned fluoroolefin copolymers becomes good.

In the compositions used for forming the afore-mentioned surface resin layer and in the compositions used for forming the afore-mentioned dye migration preventive colorable resin layer or the colorable resin layer, an ultraviolet absorber, a light stabilizer and an antioxidant may be added and included individually or in the respective combination, whereby the long term durability further can be enhanced. As such an ultraviolet absorber, known absorbers can be used, and typical ones include benzophenones, benzotriazoles, cyanoacrylates, salicylates and anilide oxalates. As the light stabilizer, hindered amines can be used, and as the antioxidant, known compounds such as hindered phenol compounds, amine antioxidants and sulfur antioxidants can be used. Herein, the use of the ultraviolet absorber, the light stabilizer and the antioxidant made of low molecular compounds would cause the problems such as the occurrence of phase caused by the phase separation from transparent resin, bleed-out, a volatilization phenomenon during a heat treatment performed for letting the sublimable dye penetrate the inside of the printing laminate, and therefore the use of high-molecular weight type ultraviolet absorber, light stabilizer and antioxidant is preferable.

The ultraviolet absorber used in the present invention includes, for example: salicylic acids such as phenyl salicylate, p-di-tert-butyl phenyl salicylate and p-octyl phenyl salicylate; benzophenones such as 2,4-dihydroxy benzophenone, 2-hydroxy benzophenone, 2-hydroxy-4-octoxy benzophenone, 2-hydroxy-4-dodecyloxy benzophenone, 2,2'-dihydroxy-4-methoxy benzophenone, 2,2'-dihydroxy-4,4'-dimethoxy benzophenone and 2-hydroxy-4-methoxy-5-sulfo benzophenone; benzotriazoles such as 2-(2'-hydroxy-5'-methylphenyl)benzotriazole, 2-(2'-hydroxy-5'-tert-butylphenyl)benzotriazole, 2-(2'-hydroxy-3'-tert-butyl-5'-methylphenyl)benzotriazole, 2-(2'-hydroxy-3',5'-di-tert-butylphenyl)-5-chlorobenzotriazole and 2-(2'-hydroxy-3',5'-di-tert-amylphenyl)benzotriazole; cyanoacrylates such as 2-ethylhexyl-2-cyano-3,3'-diphenyl acrylate and ethyl-2-cyano-3,3'-diphenyl acrylate; metal oxides such as titanium oxide, zinc oxide and cerium oxide, in addition to anilide oxalates, triazines, dibenzoylmethanes and benzylidenes.

As the ultraviolet absorber, a so-called high-molecular weight type ultraviolet absorber is available, in which the afore-mentioned ultraviolet absorber is introduced in a part of a polymer.

As the high-molecular weight type ultraviolet absorber, known ones may be used, including for example:

[2-hydroxy-4-(methacryloyloxyethoxy)benzophenone]-methyl methacrylate copolymer, [2-hydroxy-4-(methacryloyloxymethoxy)benzophenone]-methyl methacrylate copolymer,

[2-hydroxy-4-(methacryloyloxyoctoxy)benzophenone]-methyl methacrylate copolymer,

[2-hydroxy-4-(methacryloyloxydodecyloxy)benzophenone]-methyl methacrylate copolymer,

[2-hydroxy-4-(methacryloyloxybenzyloxy)benzophenone]-methyl methacrylate copolymer,

[2,2'-dihydroxy-4-(methacryloyloxyethoxy)benzophenone]-methyl methacrylate copolymer,

[2,2'-dihydroxy-4-(methacryloyloxymethoxy)benzophenone]-methyl methacrylate copolymer,

[2,2'-dihydroxy-4-(methacryloyloxyoctoxy)benzophenone]-methyl methacrylate copolymer,

[2,2'-dihydroxy-4-(methacryloyloxybenzyloxy)benzophenone]-methyl methacrylate copolymer,

[2,2-dihydroxy-4-(methacryloyloxydodecyloxy)benzophenone]-methyl methacrylate copolymer,

[2,2',4-trihydroxy-4'-(methacryloyloxyethoxy)benzophenone]-methyl methacrylate copolymer,

[2,2',4-trihydroxy-4'-(methacryloyloxymethoxy)benzophenone]-methyl methacrylate copolymer,

[2,2',4-trihydroxy-4'-(methacryloyloxyoctoxy)benzophenone]-methyl methacrylate copolymer,

[2,2',4-trihydroxy-4'-(methacryloyloxydodecyloxy)benzophenone]-methyl methacrylate copolymer,

[2,2',4-trihydroxy-4'-(methacryloyloxybenzyloxy)benzophenone]-methyl methacrylate copolymer,

[4-hydroxy-4'-(methacryloyloxyethoxy)benzophenone]-methyl methacrylate copolymer,

[4-hydroxy-4'-(methacryloyloxymethoxy)benzophenone]-methyl methacrylate copolymer,

[4-hydroxy-4'-(methacryloyloxyoctoxy)benzophenone]-methyl methacrylate copolymer,

[4-hydroxy-4'-(methacryloyloxydodecyloxy)benzophenone]-methyl methacrylate copolymer,

[4-hydroxy-4'-(methacryloyloxybenzyloxy)benzophenone]-methyl methacrylate copolymer,

[2-hydroxy-4'-methyl-4-(methacryloyloxyethoxy)benzophenone]-methyl methacrylate copolymer,

[2-hydroxy-4'-methyl-4-(methacryloyloxymethoxy)benzophenone]-methyl methacrylate copolymer,

[2-hydroxy-4'-methyl-4-(methacryloyloxyoctoxy)benzophenone]-methyl methacrylate copolymer,

[2-hydroxy-4'-methyl-4-(methacryloyloxydodecyloxy)benzophenone]-methyl methacrylate copolymer,

[2-hydroxy-4'-methyl-4-(methacryloyloxybenzyloxy)benzophenone]-methyl methacrylate copolymer,

[2-(2'-hydroxy-4'-methacryloyloxyethoxy)benzotriazole]-methyl methacrylate copolymer and

[2-(2'-hydroxy-4'-methacryloyloxyethoxy)-5-chlorobenzotriazole]-methyl methacrylate copolymer. Furthermore, a high-molecular weight type ultraviolet absorber having a molecular weight of 500 or more, such as 2,2'-methylenebis[6-(2H-benzotriazole-2-yl)-4-(1,1,3,3-tetramethylbutyl)phenol], also is preferable.

The light stabilizer functions so as to capture (couple with) radicals generated due to ultraviolet rays with efficiency and inactivate the same, whereby blocking the chain reaction to prevent the deterioration of the dye. Examples of the light stabilizer include: various hindered amines such as 4-benzoyloxy-2,2,6,6-tetramethyl piperidine, bis(2,2,6,6-tetramethyl-4-piperidyl)sebacate, bis(1,2,2,6,6-pentamethyl-4-piperidyl)sebacate, 2-(3,5-di-tert-butyl-4-hydroxybenzyl)-2-n-butyl malonic acid bis(1,2,2,2,6-pentamethyl-4-piperidyl) and tetrakis(2,2,6,6-tetramethyl-4-piperidyl)-1,2,3,4,-butane tetra carboxylate; hindered phenols such as 2,4-di-tert-butylphenyl-3,5-di-tert-butyl-hydroxybenzoate; nickel complexes such as [2,2'-thiobis-(4-tert-butyl phenolate)]-tert-butyl amine nickel (II) and [2,2'-thiobis-(4-tert-butyl phenolate)]-2-ethyl hexyl amine nickel (II); nickel salts of phosphoric ester such as nickel salt of 3,5-di-tert-butyl-4-hydroxy benzyl monoethyl ester phosphate.

Among them, a high molecular-weight type hindered amine light stabilizer having a molecular weight of 1000 or more is more preferable, which includes: a condensation polymer of N,N,N',N',-tetrakis-(4,6-bis-(butyl-(N-methyl-2,2,6,6-tetramethyl piperidine-4-yl)amino)-triazine-2-yl)-4,7-diaza decane-1,10-diamine, dibutyl amine-1,3,5-triazine-N,N'-bis(2,2,6,6-tetramethyl-4-piperidyl)-1,6-hexamethylenediamine and N-(2,2,6,6 tetramethyl-4-piperidyl)butylamine; and a polymer of poly [{6-(1,1,3,3-tetramethylbutyl)amino-1,3,5-triazine-2,4-diyl}{(2,2,6,6-tetramethyl-4-piperidyl)imino}hexamethylene {(2,2,6,6-tetramethyl-4-piperidyl)imino}], dimethyl succinate and 4-hydroxy-2,2,6,6-tetramethyl-1-piperidine ethanol.

As the antioxidant, there are two types including: a radical acceptor type in which protons are given to peroxides of generated radicals so as to stabilize the same; and a peroxide separation type in which hydroperoxides are altered into stable alcohol. As the former, phenol compounds and amine compounds are typical. As the phenol compounds, examples include: compounds such as hydroquinone and gallate; and hindered phenol compounds such as 2,6-di-tert-butyl-p-cresol, stearyl-β-(3,5-di-tert-butyl-4-hydroxyphenyl)propionate, 2,2'-methylene bis(4-methyl-6-tert-butyl phenol), 2,2'-methylene bis(4-ethyl-6-tert-butyl phenol), 4,4'-thiobis(3-methyl-6-tert-butyl phenol), 1,1,3-tris(2-methyl-4-hydroxy-5-tert-butyl phenyl)butane, 1,3,5-trimethyl-2,4,6-tris(3,5-di-tert-4-hydroxybenzyl)benzene, tris(3,5-di-tert-butyl-4-hyrdoxybenzyl)isocyanurate, and tetrakis [methylene-3(3',5'-di-tert-butyl-4-hydroxyphenyl)propionate]methane. As the amine compounds, examples include N,N'-diphenyl-p-phenylene diamine, phenyl-β-naphthylamine, phenyl-α-naphthylamine, N,N'-β-naphthyl-p-phenylene diamine, N,N'-diphenyl ethylene diamine, phenothiazine, N,N'-di-sec-butyl-p-phenylene diamine, 4,4'-tetramethyl-diamino diphenyl methane and the like As the latter, sulfur compounds and phosphorus compounds are typical. As the sulfur compounds, examples include dilauryl thiodipropionate, distearyl thiodipropionate, lauryl stearyl thiodipropionate, dimyristyl thiodipropionate, distearyl-β,β'-thiodibutyrate, 2-mercaptobenzoimidazole and dilauryl sulfide. As the phosphorus compounds, examples include: triphenyl phosphite, trioctadecyl phosphite, tridecyl phosphite, trilauryl trithio phosphite, diphenyl isodecyl phosphite, trinonyl phenyl phosphite and distearyl pentaerythritol phosphite. Quencher is a compound that absorbs ultraviolet rays and takes excitation energy from exited molecules so as to suppress the reaction of the excited molecules, and include various known metal complexes. Among these antioxidants and quencher, a hindered phenol compound having a molecular weight of 1000 or more is particularly preferable.

As the organic solvent, conventionally known solvent can be used. Specific examples include: esters such as ethyl acetate, butyl acetate and ethylcellosolve acetate; aromatic hydrocarbons such as toluene, xylene and ethylbenzene; aliphatic or alicyclic hydrocarbons such as hexane, heptane, octane, cyclohexane and ethylcyclohexane; alcohols such as methyl alcohol, ethyl alcohol, isopropanol, n-butanol and isobutanol; and ketone solvent such as acetone, methyl ethyl ketone, methyl isobutyl ketone and cyclohexanone. Among them, when polyisocyanate compounds are used as the hardening agent, the use of the alcoholic solvent must be avoided. This is because an isocyanate group and alcohol react with each other.

Specific examples of the silicon denatured acrylic resins are as follows, which shows typical examples only:

(1) a cured film obtained by adding a hydrolytic catalyst to a vinyl copolymer in which vinyl monomers having hydrolyzable silyl groups are copolymerized;

(2) a cured film obtained by adding a compound having both of an epoxy group and a hydrolyzable silyl group in one molecule to a vinyl copolymer in which vinyl monomers having amino groups and/or carboxyl groups are copolymerized;

(3) a cured film obtained by adding a polyisocyanate compound to a vinyl copolymer having a hydroxyl group in which a silicon resin is graft-polymerized; and (4) a cured film obtained by adding a hydrolytic catalyst to a vinyl copolymer having a hydrolyzable silyl group in which a silicon resin is graft-polymerized.

As the dye for sublimable ink used in the present invention, a dye having a property of sublimating or evaporating at the atmospheric pressure and at 70 to 260° C. is preferable. For example, dyes such as azo, anthraquinone, quinophthalone, styryl, diphenylmethane, triphenylmethane, oxazin, triazine, xanthene, methine, azomethine, acridine and diazine are available. Among them, 1,4-dimethylamino anthraquinone, bromide or chloride 1,5-dihydroxy-4,8-diamino-anthraquinone, 1,4-diamino-2,3-dichloro anthraquinone, 1-amino-4-hydroxyanthraquinone, 1-amino-4-hydroxy-2-(β-methoxyethoxy)anthraquinone, 1-amino-4-hydroxy-2-phenoxy anthraquinone, methyl, ethyl, propyl and butyl ester of 1,4-diaminoanthraquinone-2-carboxylic acid, 1,4-diamino-2-methoxyanthraquinone, 1-amino-4-anilinoanthraquinone, 1-amino-2-cyano-4-anilino(or cyclohexylamino)anthraquinone, 1-hydroxy-2(p-acetaminophenylazo)-4-methylbenzene, 3-methyl-4-(nitrophenylazo) pyrazolone, 3-hydroxyquinophthalone and the like are available. As basic dyes, malachite green, methyl violet and the like are available, and the use of a dye that is modified with sodium acetate, sodium ethylate, sodium methylate and the like is preferable.

Using a sublimable ink using these dyes, printing is performed to a transfer paper or an ink temporary displaying surface layer that is provided on a surface of a printing laminate by an electrophotography method, an electrographic recording method, an ink jet method, a thermal transfer method or the like. Then, heat at about 100 to 200° C. is applied to the printing laminate for about 10 seconds to several minutes using a heat vacuum applicator, an oven drier, a far infrared heating apparatus and the like. Herein, in the case of the transfer paper used, the heat is applied to the printing laminate while the printed surface of the sheet is applied to a surface of the printing laminate, and in the case where the printing is conducted to the ink temporary displaying surface layer, heating is conducted to the printing laminate as it is. Thereby, the sublimable dye is sublimated and a printed image is diffused and dyed within the colorable resin layer. As a printing method used in this step, known and common printing methods such as heat transfer printing, electrostatic printing, gravure printing, ink jet printing and the like can be used, and, in particular, it is preferable to use an ink jet printer as the printing means, which enables full color printing easily, and an on-demand type is preferable because this method is economical in terms of the usage efficiency of the ink.

Herein, the temperature of the heat treatment after the printing preferably is in the rage of 150 to 200° C. in terms of the favorable workability for carrying out the sublimation of the sublimable dye in a short time without a significant thermal damage on a releasing film or the like on a rear face of the printing laminate. Moreover, preferably, prior to the heat treatment, the printing surface may be dried to a tacky-dry level, which makes the diffusion of the sublimable dye uniform during the heat treatment. The transfer paper used in this step may be a printing paper for ink jet that is commonly on the market, and a hydrophilic resin preferably is used for the ink temporary displaying surface layer. Hydrophilic resins used for forming the above-described temporary display layer include, for example, a polyurethane resin, an acrylic resin, a fluororesin, unmodified or modified polyvinyl alcohol, polyester, acrylic urethane, a vinyl chloride maleic anhydride copolymer, sodium salt of alkyl ester, gelatin, albumin, casein, starch, SBR latex, NBR latex, a cellulose resin, an amide resin, a melamine resin, polyacrylamide and polyvinyl pyrrolidone. These materials may be cationic modified, or hydrophilic groups may be added to these materials, and one or more types of the thus prepared materials may be used.

Moreover, fillers such as silica, clay, talc, diatomaceous earth, zeolite, calcium carbonate, alumina, zinc oxide, titanium and the like may be added thereto.

Note here that when the printing laminate of the present invention is applied to the use for the attachment on a curved surface, for example, the laminate is required to have a sufficient stretching property. A lower molecular weight plasticizer and the like, however, are not suitable for this application, because such a material would induce the bleed of the dye. Meanwhile, according to the present invention, the afore-mentioned dye migration preventive layer and the metal thin layer can prevent the bleed of the dye, and therefore a broad range of resins, i.e., resins having an excellent elongation percentage, can be selected for the rear-face side of the dye migration preventive layer and the metal thin layer without restrictions to the afore-mentioned resins suitable for the dye migration preventive layer. More specifically, as materials satisfying such required properties, synthetic resins such as urethane resins, vinyl resins, acrylic resins, alkyd resins, polyester resins, epoxy resins, fluorine resins, olefin resins, silicon resins and the like are available. The dried film thickness of this layer in this step that has excellent flexibility is set at from 1 μm to 100 μm, inclusive, preferably from 3 μm to 80 μm, inclusive, and more preferably from 5 μm to 60 μm. The film thickness less than 1 μm is not sufficient for following the elongation during the stretching so as to prevent the breakage of the dye migration preventive layer. Whereas, the film thickness exceeding 100 μm makes the overall film thickness of the film too large, which degrades the capability to follow the curved surface when the film is attached to the board, and therefore such a range of film thickness is not preferable. With this configuration, the elongation percentage of the laminate can be enhanced remarkably, and cracks, which would occur during the stretching of the dye migration preventive layer and the metal thin layer, can be prevented, resulting in a printing laminate that has excellent flexibility and elongation percentage and that can prevent the bleed of the dye.

FIG. 1 is a cross-sectional view of a printing laminate according to one embodiment of the present invention. This printing laminate is made up of: a surface resin layer (A)1 that has weak affinity with a sublimable dye and that has a permeability of the dye; and a dye migration preventive colorable resin layer (B)12 that has affinity with the dye and prevents the migration of the dye, these layers being laminated in this order from the surface of the laminate.

Figure 2:
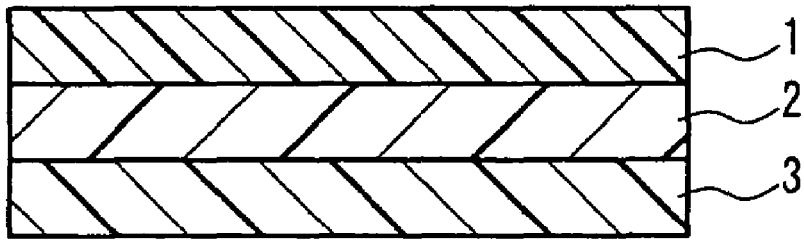
FIG. 2 is a cross-sectional view of a printing laminate according to another embodiment of the present invention.

FIG. 2 is a cross-sectional view of a printing laminate according to another embodiment of the present invention. This printing laminate is made up of: a surface resin layer (A)1; a colorable resin layer (B1)2 that has affinity with the dye; and a dye migration preventive layer (B2)3 for preventing the migration of the dye, the layers being laminated in this order from the surface of the laminate.

Figure 3:
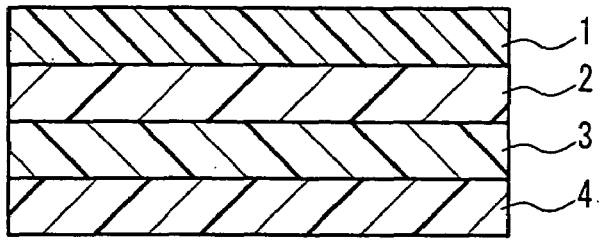
FIG. 3 is a cross-sectional view of a printing laminate according to still another embodiment of the present invention.

FIG. 3 is a cross-sectional view of a printing laminate according to still another embodiment of the present invention. This printing laminate is made up of: a surface resin layer (A)1; a colorable resin layer (B1)2; a dye migration preventive layer (B2)3; and a flexible resin layer (C)4 that has an elongation percentage larger than that of the dye migration preventive layer (B2)3, the layers being laminated in this order from the surface of the laminate.

Figure 4:
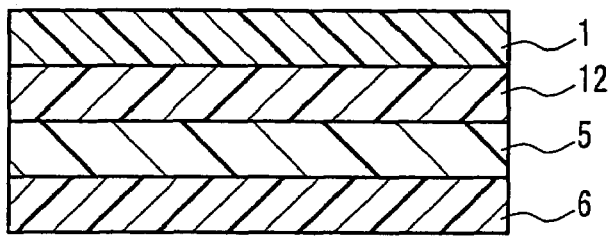
FIG. 4 is a cross-sectional view of a printing laminate according to a further embodiment of the present invention.

FIG. 4 is a cross-sectional view of a printing laminate according to a further embodiment of the present invention. This printing laminate is made up of: a surface resin layer (A)1; and a dye migration preventive colorable resin layer (B)12, which are laminated in this order from the surface of the laminate, and further is provided with an adhesive layer 5 on a rear face of the dye migration preventive colorable resin layer (B)12 and a releasing member 6 below the adhesive layer 5. An antistatic treatment is applied to the adhesive layer 5 or the releasing member 6.

Figure 5:
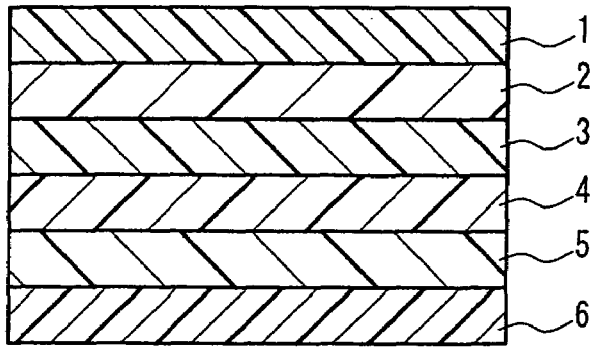
FIG. 5 is a cross-sectional view of a printing laminate according to a still further embodiment of the present invention.

FIG. 5 is a cross-sectional view of a printing laminate according to a still further embodiment of the present invention. This printing laminate is made up of: a surface resin layer (A)1; a colorable resin layer (B1)2; a dye migration preventive layer (B2)3; and a flexible resin layer (C)4 that has an elongation percentage larger than that of the dye migration preventive layer (B2)3, the layers being laminated in this order from the surface of the laminate, and this printing laminate further is provided with an adhesive layer 5 on a rear face of the flexible resin layer (C)4 and a releasing member 6 below the adhesive layer 5. An antistatic treatment is applied to the adhesive layer 5 or the releasing member 6.

Note here that, in FIGS. 1 to 3 also, the adhesive layer 5 and the releasing member 6 may be formed, and an antistatic treatment may be applied to the adhesive layer 5 or the releasing member 6.

The printing laminate shown in FIG. 1 is formed by the following steps: in the first step, a coating of the surface resin layer 1 is applied on a supporting film such as a polyethylene terephthalate film or a casting sheet so that the dried film thickness becomes about 0.5 to 300 μm, preferably about 2 to 200 μm and more preferably about 3 to 100 μm, followed by drying at room temperature or by heating. Next, in the second step, a coating for the dye migration preventive colorable resin layer 12 that follows the surface resin layer 1 is applied so that the dried film thickness becomes about 1 to 500 μm, preferably about 2 to 400 μm, and more preferably about 3 to 300 μm, followed by drying at room temperature or by heating.

The printing laminate shown in FIG. 3 is formed by the following steps: in the first step, a coating of the surface resin layer 1 is applied on a supporting film such as a polyethylene terephthalate film or a casting sheet so that the dried film thickness becomes about 0.5 to 300 μm, preferably about 2 to 200 μm and more preferably about 3 to 100 μm, followed by drying at room temperature or by heating.

Next, in the second step, a coating for the colorable resin layer 2 that follows the surface resin layer 1 is applied so that the dried film thickness becomes about 1 to 500 μm, preferably about 2 to 400 μm, and more preferably about 3 to 300 μm, followed by drying at room temperature or by heating.

In the third step, a coating of the dye migration preventive layer 3 that follows the colorable resin layer 2 is applied so that the dried film thickness becomes about 1 to 500 μm, preferably about 2 to 400 μm and more preferably about 3 to 300 μm, followed by drying at room temperature or by heating. In the fourth step, a coating for the flexible resin layer 4 that follows the dye migration preventive layer 3 is applied so that the dried film thickness becomes about 1 to 100 μm, preferably about 3 to 80 μm, and more preferably about 5 to 60 μm, followed by drying at room temperature or by heating.

Note here that these steps can be conducted by applying the coating for the flexible resin layer 4 in the first step, the coating for the dye migration preventive layer 3 in the second step and the coating for the colorable resin layer 2 in the third step and the coating for the surface resin layer 1 in the fourth step. Furthermore, if required, the process excluding the flexible resin layer 4 can be carried out. After the completion of these steps, the supporting film such as a polyethylene terephthalate film or a casting sheet is peeled off from the laminate and, if required, an adhesive layer or a glue layer may be formed on a rear face of the laminate, i.e., on a layer on the opposite side of the surface resin layer, and moreover a releasing member such as a releasing paper or a releasing film may be attached to the adhesive layer or the glue layer so as to complete the printing laminate. Herein, in the case where a biaxially stretched polyester film is used as the dye migration preventive layer 3, the aforementioned supporting film doubles as the dye migration preventive layer 3, and therefore the step for peeling the supporting film off from laminate can be omitted. The drying conditions after the application of the coatings in the aforementioned first, second, third and fourth steps may be determined appropriately depending on the types of a base resin used as the coating material, the types of the functional group in the base resin, the types of the reactive functional group in the base resin, the types of the hardening agent and the types of the solvent. The coating in each step may be applied by means of a spray, or a normally used coater such as a knife coater, a comma coater, a roll coater, a reverse roll coater and a flow coater. When a clear coating that does not contain a pigment is used as the coating used for forming each layer in the printing laminate of the present invention, a colorless printing laminate can be obtained. However, when a color coating that contains a pigment is used as the coating for forming the surface resin layer and the lower layer continuous with the layer, a colored printing laminate can be obtained. As the pigment used for obtaining the thus colored coating, known pigments including: organic pigments such as copper phthalocyanine blue, copper phthalocyanine green, quinacridone red and hansa yellow; inorganic pigments such as ferric oxide red, ferric oxide yellow, titanium white, cobalt blue, carbon black and the like are suitable. Moreover, when "CHROMAFLAIR PIGMENT" (produced by Flex Products Inc.) is used, this pigment having a five-layered structure of the pigment itself and generating interference wavelengths having spectral effects for visualization such that incident light is reflected by about 50% at the surface layer and by the remaining about 50% at the OPAQUE·REFLECTOR·METAL as the middle layer, different colors can be visualized, and therefore such a configuration is preferable because a printing laminate having an excellent designing ability can be obtained. The same effects can be obtained from "VARIOCROM" (trade name, produced by BASF Inc.) in which a surface of aluminum flake pigment is coated with iron oxide.

The configuration, in which a light diffusion layer with light diffusing fine particles mixed therein is formed in at least one layer of the surface resin layer 1, the dye migration preventive colorable resin layer 12, the dye migration preventive layer 3 and the lower layers of these, is preferable, because such a printing laminate of the present invention can be used as an internal illumination type film (a film for backlight). In this case, the mixture of the light diffusing fine particles in the lower layer side than the color layer is more preferable, because the clarity and the coloring properties cannot be adversely affected.

The afore-mentioned light diffusing fine particles making up the light diffusion layer include for example: silica, calcium carbonate, titanium dioxide, aluminum hydroxide, acrylic resin, organic silicone resin, polystyrene, urea resin, formaldehyde condensate and the like. Among them, at least one type may be selected, and they are not the limiting examples.

As an optically transparent resin functioning as a binder of the light diffusion layer with the light diffusing fine particles dispersed and mixed therein, acrylic resins, polyurethane resins, polyester resins, polyvinyl chloride resins, polyvinyl acetate resins, cellulosic resins, polyamide resins, fluorine resins, polypropylene resins, polystyrene resins alone or in combination of them are preferable. Alternatively, each of the resins are three-dimensionally cured with a functional group of a hardening agent such as a melamine resin, an isocyanate resin and an epoxy resin so as to form a resin composition, and the use of the resin composition is more preferable, which is not a limiting example. A favorable difference in refractive index between the optically transparent resin and the light diffusing fine particles generally is about 0.02 or more. Furthermore, Tg (glass transition temperature) of the optically transparent resin preferably is 50° C. or more, and Tg less than 50° C. would cause problems concerning a keeping quality due to blocking when the light diffusion layer and other members contact with each other, and therefore such temperatures are not preferable.

Among these resins, the use of acrylic resins, polyurethane resins, polyester resins, polyvinyl chloride resins and poly vinyl acetate resins alone or in combination of them are preferable, because they have an excellent dispersion suitability (wettability) of the light diffusing fine particles and controllability of the difference in refractive index. The use of a resin composition is more preferable, in which each of the resins is three-dimensionally cured with a functional group of a hardening agent such as a melamine resin, an isocyanate resin and an epoxy resin.

The light diffusion layer may be manufactured as follows: an optically transparent resin and one or more types of light diffusing fine particles are dissolved or dispersed in an appropriate organic solvent (or water), the resultant is applied using a general application method such as roll coating and knife coating, followed by drying and evaporation of the organic solvent (or water), and furthermore, if required, a curing reaction of the resin with a hardening agent may be advanced. The application method may be selected appropriately depending on the viscosity of the composition of the light diffusion resin, the targeted thickness of the coating and the like. The amount of the light diffusing fine particles to be added preferably is 1 to 40 weight % with respect to the optically transparent resin, and they may be dispersed and mixed depending on the required properties. The desirable application film thickness of the light diffusion layer is about 3 to 50 μm in general, which is not limiting one.

According to the printing laminate having the afore-mentioned light diffusion layer function, when illumination light is incident from the rear face of the laminate that is the opposite side of the surface resin layer, light from a linear light source such as a fluorescent lamp of backlight can be diffused uniformly, which means a bright planar illuminant, and reflection on the surface by the fluorescent lamp on the rear face also can be prevented. At this time, light passes through also the coloring layer in which printing has been conducted in the colorable resin layer using the sublimable dye, and therefore the function as the internal illumination type signboard can be exerted. Herein, since the sublimable dye has a significantly good transparency, a large amount of ink should be used for printing in order to increase the transmittance density to a desired density. Therefore, the printing workability deteriorates and a problem occurs concerning the drying properties after the printing. In order to cope with this problem, it was found that a white pigment may be used in the layer subjected to the sublimable dyeing so as to function as a white layer, whereby the transmittance density of the printed image could be enhanced.

In this connection, in order to improve the sharpness, it was found that the formation of the white layer using a white pigment in at least one layer of the afore-mentioned dye migration preventive colorable resin layer 12, the colorable resin layer 2 and the dye migration preventive layer 3 could enhance the transmittance density of the printed image. Herein, in the case where the dye migration preventive colorable resin layer further is divided into a transparent resin layer as an upper layer and a white layer as a lower layer, in addition to a colorable resin layer and a dye migration preventive layer, the colorable resin layer further may be divided into a transparent resin layer as an upper layer and a white layer as a lower layer. This configuration is more preferable, because the sharpness of the image can be kept and the transmittance density can be enhanced. Herein, a white pigment used for whitening may be any one that is used normally for coloring synthetic resins in white, including, more specifically, titanium oxide, zinc oxide, lead carbonate, barium sulfate, zinc sulfide, antimony oxide, specific titanates represented by $MTiO_3$ (M denotes at least one element selected from the group consisting of Mg, Ca, Sr and Ba) and the like. The usage of the white pigment here preferably is set so that the transmittance density V of the white layer (measured by density measuring apparatus DM-201 produced by Noritsu Koki Co., Ltd.) is 0.10 to 1.70, preferably 0.15 to 1.65 and more preferably 0.20 to 1.40. The transmittance density V of the white layer less than 0.10 would not be sufficient for increasing the transmittance density of the image, whereas the transmittance density exceeding 1.70 would cause insufficiency in the transmissivity of the light, thus degrading the characteristics of the internal illumination type signboard, and therefore such a range of transmittance density is not preferable.

The configuration, in which a retroreflective structure described later is manufactured in the lower layer continuous with the afore-mentioned dye migration preventive colorable resin layer 12, the lower layer continuous with the dye migration preventive layer 3 or the lower layer of the flexible resin layer 4, is preferable for various advertising signboards including traffic signs, because, even in the nighttime, the illumination by a headlight of vehicles allows light to be reflected precisely in the direction of the light source, thus allowing a full colored image similar to the daytime to be visually recognized by drivers of the vehicles. Furthermore, since the printing of an image in an on-demand method is enabled, there is no need to manufacture a plate per image, which is required for silk screen printing that is applied to a retroreflective sheet conventionally, and therefore this configuration is significantly effective for reducing the cost.

The following describes exemplary manufacturing methods (1) to (3) of the retroreflective sheet.

Figure 6:
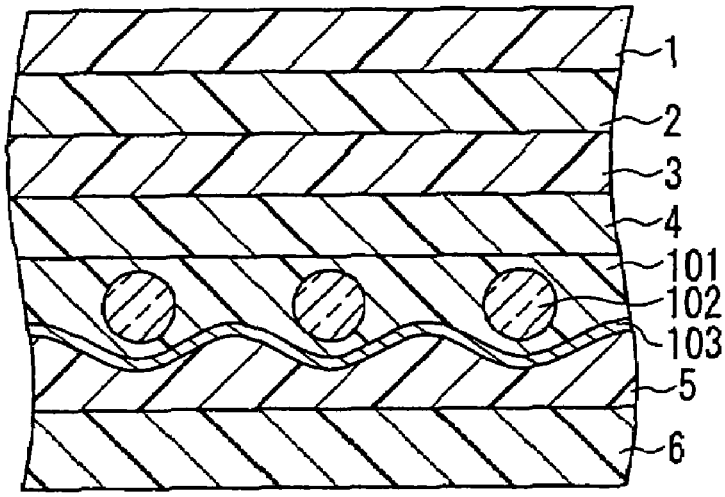
FIG. 6 is a cross-sectional view of a printing laminate according to another embodiment of the present invention.

(1) As shown in FIG. 6, a focus resin composition, in which high refractive glass beads 102 are mixed, is applied at a lower layer of the afore-mentioned respective resin layers so that an optimum dried film thickness as a focus layer film 101 can be obtained, followed by drying at room temperature or by heating. Herein, although the optimum dried film thickness of the focus layer may vary according to the particle diameter of the glass beads, the film thickness may be about 10 to 70 μm. Next, a reflective layer made of a metal reflective layer 103 is formed. Preferable coating used here for the focus resin composition contains as a base polymer composition polyurethane resins, polyvinyl acetal resins, acrylic resins, alkyd resins, polyester resins and the like. These resins may be used as a non cross-linking type or may be used as a thermosetting type by mixing a hardening agent such as amino resins, epoxy resins and polyisocyanate, block polyisocyanate.

Furthermore, drying conditions after the application of the coating for the focus resin composition in the above may be determined appropriately depending on the types of a base resin used as the coating material, the types of the reactive functional group in the base resin, the types of the hardening agent and the types of the solvent.

Preferably glass beads used here have a refractive index of 1.90 to 2.40 and more preferably 2.10 to 2.30. The particle diameter thereof preferably is from 5 to 300 μm, more preferably from 20 to 100 μm. The particle diameter of the beads less than 5 μm would make the required film thickness of the focus layer too small, thus making it difficult to control the film thickness. Whereas, the particle diameter exceeding 300 μm would make the required film thickness of the focus layer too large, thus making it difficult to shape the resin concentrically with the spherical diameter of the glass beads, which is due to the flow of the resin during heating for the shaping. The refractive index less than 1.9 would make the required film thickness of the focus layer too large, thus making it difficult to shape the resin concentrically with the spherical diameter of the glass beads. In addition, it is extremely difficult to manufacture industrially the beads having a refractive index exceeding 2.4 so as to prevent the crystallization and form transparent glass beads precisely.

A method for providing the afore-mentioned metal reflective layer 103 is not limited especially, and normally used methods such as sputtering, transferring and a plasma method are available. In particular, in terms of the workability, evaporation and sputtering are preferably used. Metals used for forming such a metal layer also are not limited especially, and metals such as aluminum, gold, silver, copper, nickel, chrome, magnesium and zinc are available. Among these metals, in terms of the workability, the easiness of the formation of the metal reflective layer, the durability of reflective efficiency of light and the like, aluminum, chrome and nickel are particularly preferable. The above metal reflective layer may be formed of an alloy including two or more kinds of metals. Although its thickness may vary depending on the metal used, the thickness may be from 5 to 200 nm, preferably from 10 to 100 nm. The thickness of the afore-mentioned metal reflective layer less than 5 nm cannot achieve the objective as the reflective layer, because the screening capability of the metal reflective layer is not sufficient. The thickness exceeding 200 nm, inversely, may cause the tendency to generate cracks in the metal reflective layer and the cost also is increased, and therefore such a thickness is not preferable.

Figure 7:
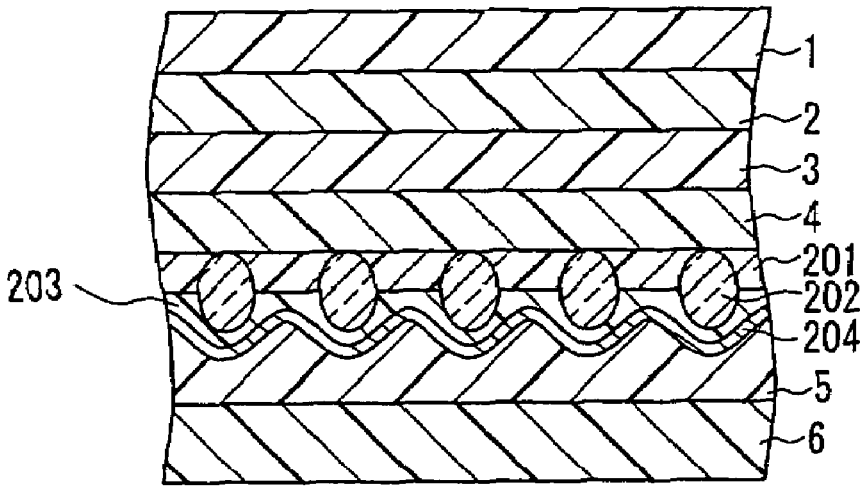
FIG. 7 is a cross-sectional view of a printing laminate according to still another embodiment of the present invention.

(2) As shown in FIG. 7, a coating for forming a glass beads fixing layer 201 is applied at a lower layer of the afore-mentioned respective resin layers so that the dried film thickness of the glass beads fixing layer 201 is in the range of 100 μm from the thickness of 10% of the glass beads particle diameter used, preferably in the range of 80 μm from the thickness of 20% of the glass beads particle diameter used, followed by drying at room temperature or by heating so as to allow a solvent to evaporate. Next, high refractive glass beads 202 are embedded therein. Typical coatings used for forming the glass beads fixing layer include a mixture of fluoroolefin copolymers containing a reactive functional group, polyester resins, alkyd resins, polyurethane resins, acrylic polymers having a reactive functional group as a base resin component with a hardening agent and/or a hardening catalyst such as amino resins, epoxy resins, polyisocyanate and block polyisocyanate. Herein, the afore-mentioned base resin component may be used alone or as a mixture of two or more types. As the application form, a solution type, a non water dispersion type, a water soluble type and a water dispersion type can be all available, and a solution type is particularly preferable.

Next, the coating for the focus resin composition described in the above (1) is applied so as to obtain an optimum dried film thickness as the focus layer film 203, followed by drying at room temperature or by heating.

The coating in each step in the above may be applied by spray coating, or a normally used coater such as a knife coater, a comma coater, a roll coater, a reverse roll coater and a flow coater.

When a clear coating that does not contain a pigment is used as the coating used for forming each layer in the retroreflective sheet of the present invention, a colorless retroreflective sheet can be obtained. Alternatively, when a color coating that contains a pigment is used as the coating for forming the respective layers in FIG. 6 and FIG. 7, a colored retroreflective sheet can be obtained as well. As the pigment used for obtaining the thus colored coating, known and conventional pigments including: organic pigments such as copper phthalocyanine blue, copper phthalocyanine green, quinacridone red and hansa yellow; inorganic pigments such as ferric oxide red, ferric oxide yellow, titanium yellow and cobalt blue and the like can be used.

For the thus obtained retroreflective sheet of the present invention, after the formation of the metal reflective layer 204 as described above, an adhesive layer or a glue layer may be formed on the lamination of the metal reflective layer, and moreover, if required, a releasing member such as a releasing paper or a releasing film may be attached thereto so as to form a final product.

Figure 8A:
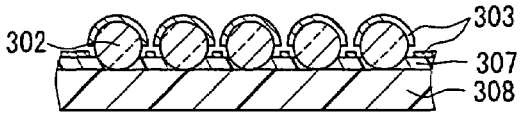
FIG. 8 shows the steps for manufacturing a further embodiment of the present invention, wherein FIG. 8A schematically shows the cross-section of a portion in which a glass beads temporary zing layer is formed on a polyester film, on a surface of which transparent glass beads are embedded and a metal reflective layer is formed thereon.
FIG. 8B schematically shows the cross-section of a portion in which a primer layer is formed on a polyester film and a supporting resin sheet is formed thereon.
FIG. 8C schematically shows the cross-section of a portion in which the supporting resin sheet is brought along the surface of the glass beads temporary fixing layer.
FIG. 8D schematically shows the cross-section of a portion in which pressure is applied to the supporting resin sheet toward the surface of the glass beads temporary fixing layer.
FIG. 8E schematically shows the cross-section of a portion in which the polyester film together with the glass beads temporary fixing layer are peeled off from the surface of the supporting resin sheet.
FIG. 8F schematically shows the cross-section of a portion in a state where the surface of the supporting resin sheet is covered with the printing laminate of the present invention before thermo compression shaping is performed using a patterned emboss roll.
FIG. 8G schematically shows the cross-section of a portion in which the thermo compression shaping is being performed using the patterned emboss roll.

(3) As shown in FIG. 8A, a plurality of transparent glass beads 302 are embedded in the planar form at the surface of a glass beads temporary fixing layer 307 made of polyethylene that is laminated on a polyester film 308. Heat is applied to a polyethylene laminate film (the glass beads temporary fixing layer 307 and the polyester film 308) so as to soften the polyethylene, whereby the glass beads 302 are embedded. These glass beads 302 are fine particles having a particle diameter of about 5 to 300 μm and a refractive index of about 1.8 to 2.1. In particular, preferable glass beads have a refractive index of about 1.9 to 1.95 (particularly preferably, 1.92 to 1.93) and a particle diameter of about 20 to 90 μm (particularly preferably, 40 to 80 μm).

Next, a metal reflective layer 303 is formed by evaporation on the hemispherical faces of the glass beads 302 that are exposed from the surface of the afore-mentioned glass beads temporary fixing layer 307. This evaporation is performed to the entire surface of the glass beads temporary fixing layer 307. Then, the metal reflective layer 303 that is evaporated to the portions other than the glass beads 302 on the surface of the glass beads temporary fixing layer 307, which will be described later, remains on the surface of the glass beads temporary fixing layer 307 as it is, and the other portions of the metal reflective layer 303 are transferred to a supporting resin sheet 304 together with the glass beads (FIG. 8E). As the afore-mentioned metal reflective layer 303, an aluminum reflective layer is preferable, and layers made of other metals such as gold, silver, copper, nickel and chrome are applicable.

As the next step, a method for manufacturing a retroreflective sheet having the following two types of structures may be carried out:

(A) a type with a primer layer 305; and (B) a type without a primer layer

In the case of the above (A), an adhesive layer is laminated on a rear face of the primer layer 305, and in the case of the above (B), an adhesive layer is laminated on a rear face of the supporting resin sheet 304. In order to adjust the glass beads transferring capability of the supporting resin sheet in which the glass beads in the glass beads temporary fixing layer are to be transferred and embedded, a high polymer or a low molecular plasticizer or the like should be used as the supporting resin sheet in some cases. Such a plasticizer might transfer to the interface between the adhesive and the supporting resin sheet or the adhesive layer with the passage of time and degrade the properties of the adhesive. That is, the adhesion of the interface between the adhesive and the supporting resin sheet, the adhesion properties of the adhesive to the board and the like might deteriorate. In order to solve these problems, i.e., to prevent the transferring of the plasticizer from the supporting resin sheet to the adhesive layer, the primer layer may be laminated in some cases.

Regarding the type (A) having the primer layer 305, resins having an excellent interlayer adhesion with the supporting resin sheet may be selected as a resin for the primer layer 305 from resins having the afore-mentioned functional groups or hardening agents having functional groups reacting with these resins and with the functional groups of these resins. Then, a solution of the thus selected resin for the primer layer 305 is coated on a polyester film 306 that is prepared separately, followed by drying using a hot air dryer. The thickness of the primer layer 305 in this step may be 3 μm to 100 μm, preferably 6 μm to 50 μm. The thickness less than 3 μm is not preferable, because the effect for preventing the migration of the plasticizer or the like would deteriorate, whereas the thickness exceeding 100 μm is not preferable, because the workability of the attachment of the reflective sheet and the like would deteriorate.

Figure 8B:
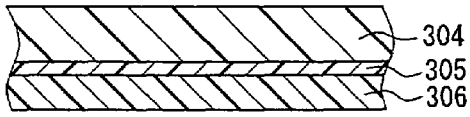

Following this, the supporting resin sheet 304 having a uniform thickness of about 10 to 300 μm, preferably about 30 to 100 μm, is manufactured on the primer layer 305 formed as above (FIG. 8B). As resins applicable to this supporting resin sheet 304, resins having the afore-mentioned functional groups are preferable.

Figure 8C:
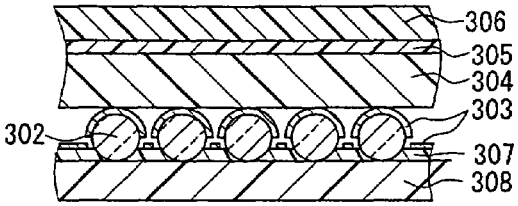
Figure 8D:
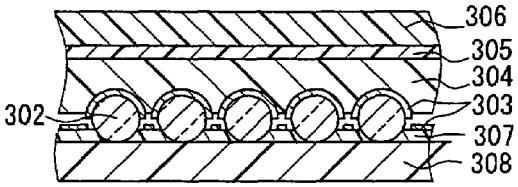
Figure 8E:
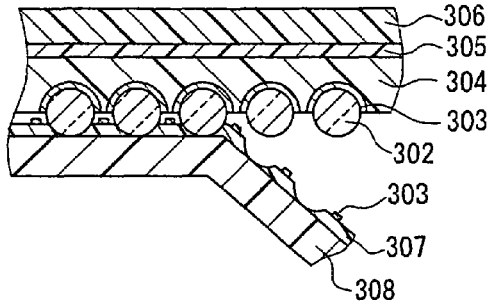

The type (B) that does not have the primer layer 305 can be implemented by the afore-mentioned manufacturing method of the retroreflective sheet in which the steps for forming the primer layer are omitted. Next, as shown in FIG. 8C, the supporting resin sheet 304 as stated above is brought along the surface of the glass beads temporary fixing layer 307. Then, as shown in FIG. 8D, pressure is applied to the supporting resin sheet 304 toward the surface of the glass beads temporary fixing layer 307. The pressure is applied so that the hemispherical faces of the glass beads 302 with the metal reflective layer 303 evaporated thereon can be embedded in the supporting resin sheet 304. In this step, in order to increase the fixing force of the glass beads 302 with the supporting resin sheet 304, it is effective to further add a coupling agent or the like to the supporting resin sheet 304. Then, as shown in FIG. 8E, the polyester film 308 together with the glass beads temporary fixing layer 307 are peeled off from the surface of the supporting resin sheet 304. In this step, as shown in FIG. 8E, the glass beads 302 remain in the supporting resin sheet 304 so that the hemispheres remain embedded in the supporting resin sheet 304. After that, in the case where the curing form in which the reaction proceeds at room temperature (e.g., isocyanate curing) is applied to the primer layer and/or the supporting resin sheet, an aging treatment preferably is performed in the environment at 30 to 40° C. to finish the reaction substantially, in order to remove variations in properties of the connecting portions during the following shaping process by heating and in order to stabilize the self-sustaining form after the process. Furthermore, in order to enhance the adhesion property between the glass beads and the supporting resin sheet, it is effective to perform a heat treatment at 120 to 150° C.

Figure 8F:
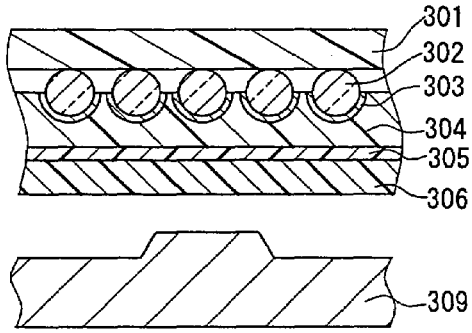
Figure 8G:
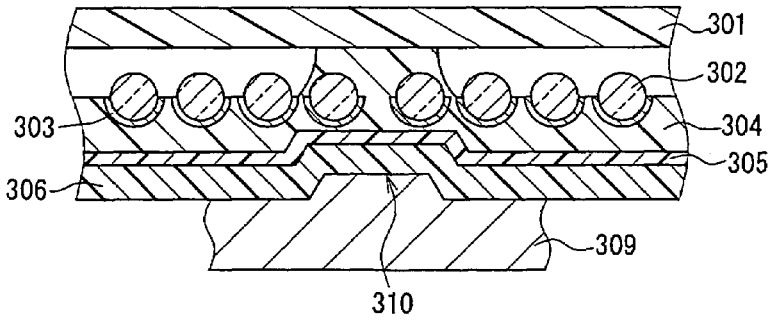

Next, the surface of the supporting resin sheet formed in the state shown in FIG. 8F is covered with the dye migration preventive colorable resin layer 12 of the printing laminate or the dye migration preventive layer 3 or the flexible resin layer 4 of the same. FIG. 8F shows the example covered with the flexible resin layer 4. Thermo compression shaping is performed using a patterned emboss roll 309 from the rear-face polyester film side 306 of the supporting resin sheet 304 in which the resin layer is disposed (FIG. 8G). As means for this thermo compression shaping, it is preferable to allow a heated roll whose surface temperature is at 150 to 240° C., preferably at 170 to 220° C. to pass through. A supporting resin sheet capable of being thermo-compression shaped at a temperature less than 150° C. and exhibiting adhesion with the surface film is not preferable, because such a sheet cannot keep the self-sustaining form for a long time. A supporting resin sheet capable of being thermo-compression shaped at a temperature exceeding 240° C. also is not preferable, because such a sheet would cause a deterioration in the workability during the shaping by heating, for example, a polyester film used as a protective film may melt during the shaping by heating.

After the shaping by heating, the rear-face polyester film 306 is peeled off, so as to manufacture a raw fabric of a high-brightness retroreflective sheet. Thereby, an emboss groove 310 having a width of 200 to 800 μm and a depth of 100 to 150 μm, for example, is formed on the rear face side of the supporting resin sheet 304.

An adhesive layer or a glue layer may be formed so as to cover the emboss groove, and moreover, if required, a releasing member such as a releasing paper or a releasing film may be attached to the adhesion layer or the like so as to form a final product.

As the retroreflective sheet that is located at the lower layer of the printing laminate of the present invention, various known retroreflective sheets can be applied in addition to the afore-mentioned retroreflective sheet.

In the printing laminate according to the present invention obtained through the afore-mentioned process, also in the case of the structure other than the afore-mentioned retroreflective sheet, the dye migration preventive layer 3, the flexible resin layer 4 or a metal evaporation film may be formed on the opposite of the surface side, and thereafter, if required, an adhesive layer or a glue layer may be laminated on these layers and a releasing member such as a releasing paper or a releasing film may be attached to the adhesive layer or the glue layer so as to form a finished product of the printing laminate. The releasing member used herein may include an antistatic agent added by kneading or an antistatic agent may be applied on the surface of the releasing member in order to reduce an electrical resistance of the surface of the releasing member, thus preventing the generation of static electricity. This configuration is preferable, because instability of a printed image, caused by fluctuations in the discharge direction of an ink from a nozzle for printing, can be prevented, which results from the static electricity generated when the sheet is wound off or the static electricity generated by the friction between the printing laminate and a printer during the printing by an ink jet printer. The antistatic agents used herein include various surface-active agents, inorganic salts, polyhydric alcohols, metal compounds, carbons and the like. For instance, as the surface-active agents, various surface-active agents including: anionic antistatic agents such as alkyl sulfonates, alkylbenzene sulfonates, alkyl sulfate ester salts, alkyl ethoxy sulfate ester salts and alkyl phosphoric ester salts; cationic antistatic agents such as alkyl trimethyl ammonium salts, acyloylamidopropyl trimethyl ammonium methosulfate, alkyl benzyl dimethyl ammonium salts and acyl choline chloride; amphoteric antistatic agents such as alkyl betaine types, alkyl imidazoline types and alkyl alanine types; and nonionic antistatic agents such as fatty acid alkylolamide, di-(2-hydroxyethyl)alkylamine, polyoxyethylene alkylamine, fatty acid glycerin ester, polyoxyethylene fatty acid glycol ester, fatty acid sorbitan ester, polyoxy fatty acid sorbitan ester, polyoxyethylene alkylphenyl ether and polyoxyethylene alkyl ether are included. In the case where the releasing member 6 is a polyethylene terephthalate, 5 weight % of polyethylene glycol may be copolymerized during the polymer synthesis, for example.

Note here that, as the afore-mentioned releasing member, a biaxially stretched polyester film to which anneal processing has been conducted by heating beforehand preferably is applied as a base film, and a biaxially stretched polyester film whose shrinkage ratio is 1.0% or less in the winding direction of the film when heat is applied at 150° C. for 30 minutes, preferably 0.8% or less, and more preferably 0.6% or less is applied preferably as the base film. The releasing member with a shrinkage ratio exceeding 1.0% makes the printing laminate curled toward the releasing member side when the printing laminate of the present invention is heated for sublimation dyeing.

Furthermore, if required, a coating formation composition including fine particles made of hydrotalcites represented by $[M^{2+}_{1-X}M^{3+}_{X}(OH)_2]^{X+}[A^{n-}_{X/n}.mH_2O]^{X-}$($M^{2+}$denotes divalent metal ions, $M^{3+}$ denotes trivalent metal ions, $A^{n-}$ denotes anions, $0<X\leqq 0.33$, $0\leqq m\leqq 2$ and metal oxides may be applied to the surface resin layer 1, followed by drying. Thereby, a coating exhibiting affinity for water can be formed, which means the formation of a firmly constructed surface having a sufficiently small contact angle for water, thus preventing the contamination due to the affinity for water and preventing the adhesion of waterdrops due to condensation, which impairs the retroreflective effect, and therefore sufficient retroreflective capability can be secured in the nighttime. Thus, this configuration is suitable for the applications to various advertising signboards including traffic signs. Furthermore, the above compositions are significantly preferable, because they can exhibit the water affinity properties with a film thickness of 1 μm or less and can keep the long-term water affinity properties in the open air and when a sublimable dye is allowed to penetrate from the surface resin layer into the printing laminate, the penetration of the dye is not hindered. As the fine particles of the metal oxides, titanium oxide particles, in particular a slurry solution of titanium oxide, are the most preferable. However, instead of titanium oxide, transition metal oxides such as zirconium oxide, strontium titanate, tungstic oxide, iron oxide and the like and other metal oxides such as zinc oxide, bismuth oxide, tin oxide, alumina, magnesia and strontium oxide also can be used. The average particle diameter preferably is within the range of 0.001 to 0.5 μm, and particularly preferably 0.01 to 0.1 μm.

Furthermore, if required, a temporary displaying surface layer with releasing properties may be laminated on the surface side of the printing laminate. The temporary displaying surface layer herein may be manufactured by applying a resin for the temporary displaying surface layer using the afore-mentioned application apparatus so that the dried film thickness becomes about 1 μm to 100 μm, preferably about 3 μm to 80 μm and more preferably about 5 μm to 60 μm. Moreover, if required, the temporary displaying surface layer may be manufactured to include a lamination film of two or more layers. In that case, this layer can be manufactured by laminating the layers from the lower layer to the upper layer sequentially. Note here that, in this case, the uppermost side of the temporary displaying surface layer preferably is made of a resin having absorbing properties of an ink containing a sublimable dye and the layer on the side contacting with the surface resin layer (A)preferably is made of a resin having non-affinity with the sublimable dye.

Above all, according to the printing laminate of the present invention in which the temporary displaying surface layer is laminated on the surface side, an image photographed by a commercially available digital camera can be printed directly on the temporary displaying surface layer of the printing laminate, and the following heat treatment at 150 to 200° C. for several minutes allows the sublimable dye printed in the temporary displaying surface layer to diffuse and penetrate the inside of the printing laminate, thus forming an image easily. This image has a high resolution equal to a conventional silver-halide photograph, and as a result of the 1000-hour test using a sunshine carbon type accelerated weathering tester specified by JIS Z 9117 (which equals atmospheric exposure test, facing to the south at right angles, for 5 years), the image showed a high durability such that it was free from abnormalities and fading was hardly recognized. This would equal the storage stability within doors for the time period far exceeding 100 years, and compared with a picture by a conventional silver-halide photograph or a widely available aqueous ink jet printer, a larger size image can be produced at a lower cost than the conventional one. Furthermore, the disposal of a developer, which is required for silver-halide photograph, becomes unnecessary, and therefore a photographed image that is more environmental friendly and is significantly sharp with high durability and high storage stability can be obtained.

As a method for implementing the heating and diffusing printing in this step, an indirect heating method and a direct heating method are available. The indirect method includes heating by hot air, heating by irradiation with far infrared radiation and the like, and the direct method includes a method for bringing the printing laminate in direct contact with a heating plate, for winding the printing laminate around a heated roll and the like. Either of these heating methods can be selected, or these methods may be used concurrently. Although heating at high temperatures of 150 to 200° C. is required for the diffusion dyeing, if the temperature of the printing laminate itself is increased rapidly to the afore-mentioned high temperatures, the rapid thermal expansion of the sheet occurs, thus generating the abnormalities in the appearance of the sheet such as wrinkles, and therefore such a process is not preferable. As a result of keen examinations by the inventors of the present invention in order to cope with these problems, heat may be applied in the order of the initial heating at 70 to 130° C., followed by at 120 to 150° C., and in the case where the temperature further is to be increased, followed by 140 to 200° C., and then the temperature may be decreased as in at 120 to 150° C., followed by at 70 to 130° C. and at room temperature. In this way, when the diffusion printing is conducted in a cycle of the rise of the temperature sequentially with thermal gradient, heating at a constant temperature and the fall of the temperature, the contraction of the sheet due to the thermal expansion and the temperature fall can be alleviated, so that abnormalities in the appearance such as wrinkles do not occur, and therefore such a condition is preferable. Furthermore, preferably, the initial rise of the temperature takes 10 to 60% of the total heating time, the heating at a constant temperature takes 20 to 80% of the total heating time and the fall of the temperature takes 10 to 40% of the total heating time. More preferably, the initial rise of the temperature takes 15 to 35% of the total heating time, the heating at a constant temperature takes 30 to 70% of the total heating time and the fall of the temperature takes 15 to 35% of the total heating time. Moreover, in the case of heating with rolls, the use of a cambered roll whose central portion is thicker than both end portions is preferable for the process of the fall of the temperature, because this can prevent wrinkles that are generated caused by the contraction of the sheet during the fall of the temperature. The gradient of the cambered roll used here preferably is set so that a difference in diameter per width of 1000 mm between the both end portions and the central portion becomes 0.5 to 10 mm, preferably 1 to 5 mm. In the case of the indirect heating, preferably, at the entrance of a heater, a sheet may be sandwiched between upper and lower two rolls and may be transferred sequentially by a lower support guide roll that is driven, and if required, an upper press roll may be provided at some midpoint of the transferring to sandwich the sheet in order to assist the smooth transferring of the sheet. In this way, the indirect heating is preferable because this allows a required quantity of the printing laminate to be heated without loss. In the case where a separate sheet is to be heated, the sheet may be left on a heated plate heated at a required temperature. Herein, in the case where consecutive processing is carried out using a heated roll, in addition to the afore-mentioned conditions, the tension for winding may be set at 5 to 40 kg/m width, preferably at 10 to 30 kg/m width, which can prevent wrinkles occurring in the sheet. The tension less than 5 kg/m width would cause wrinkles during the winding, and the tension exceeding 40 kg/m width applies unnecessary stretching to the sheet, and therefore such a range of tension is not preferable.

WORKING EXAMPLES

The present invention will be described more specifically by way of the following Working Examples. In the following Working Examples, "parts" refer to parts by weight, and "%" refers to percentage by weight.

Working Example 1

When preparing a resin composition for the surface resin layer 1 shown in FIG. 1, a resin composition containing: about 100 parts of a solution of a copolymer of hexafluoropropylene/ethylvinylether/VEOVA9/monovinyl adipate=50/15/20/15 (weight percentage), which had the weight average molecular weight of about 45000, as a fluorine resin ("VEOVA9": trade name produced by Japan Epoxy Resins Co., Ltd., vinylester of branched fatty acid, the solvent is a mixture solvent of toluene/n-butanol=70/30 (weight percentage), containing non-volatile matter of about 50%); about 7.4 parts of sorbitol polyglycidylether having an epoxy equivalent of 170; about 0.6 part of diaza-bicyclo-octane; about 1 part of TINUVIN900 (produced by Ciba Specialty Chemicals Inc., benzotriazole based ultraviolet absorber); and about 1 part of TINUVIN292 (produced by Ciba Specialty Chemicals Inc., hindered amine based light stabilizer) was applied on a polyester film so as to have a dried film thickness of about 20 μm, followed by drying by heating at about 140° C. for about 10 minutes to obtain the surface resin layer 1. Following this, on the thus manufactured surface resin layer 1, a resin composition, in which about 100 parts of the vinyl copolymer (a-1) synthesized in the afore-mentioned Reference Example 1; and about 25 parts of BURNOCK DN-950 as a hardening agent (polyisocyanate prepolymer produced by Dainippon Ink and Chemicals, Inc., containing non-volatile matter of about 75%) were mixed, was applied to have a dried film thickness of about 30 μm, followed by drying by heating at about 140° C. for about 10 minutes to manufacture a dye migration preventive colorable resin layer 12. On the surface of the thus obtained dye migration preventive colorable resin layer 12 of the printing laminate, as shown in FIG. 4, a mixture solution including: about 100 parts of FINETAC SPS-1016 as an acrylic adhesive (produced by Dainippon Ink and Chemicals, Inc.,); and about 2 parts of FINETAC TA-101-K as a cross-linking agent (produced by Dainippon Ink and Chemicals, Inc., hardening agent for adhesives, chelate type) was applied, followed by drying by heating at about 100° C. for about 5 minutes to form an adhesive layer 5 having a thickness of about 35 μm. Furthermore, a releasing film 6 made of a biaxially stretched polyester releasing film having a thickness of 50 μm whose one side was coated with silicon and the other side was subjected to antistatic finish and further annealed (produced by Teijin DuPont Films Japan Limited, trade name: A-31, having a shrinkage ratio of 0.4% in the winding direction of the film when heated at 150° C. for 30 minutes) was attached to this adhesive layer 5, and thereafter the polyester film as the supporting film was peeled off so as to form a final product.

Next, an image was printed on a transfer paper (Gradess S-coat Paper) by a piezo-type printer, which was a kind of ink jet method printers separately prepared (by Mutoh Industries Ltd. RJ-6000). An ink for sublimable ink jet used here was produced by Kiwa Chemical Ind. Co., Ltd., which contained a sublimable dye (a set of six colors including cyan, magenta, yellow, black, light cyan and light magenta). The printed surface of the transfer paper was applied to the surface resin layer 1 of the printing laminate manufactured as above, and heat and pressure were applied using a heat vacuum applicator (HUNT EUROPE, VacuSeal 4468) at the setting temperature of about 170° C. for about 7 minutes and at the degree of vacuum of $3.99\times10^3$ Pa (30 mmHg), whereby heat was applied to both of the printing laminate and the transfer paper so as to allow the diffusion and the dyeing of the image printed on the transfer paper into the printing laminate and the transfer of the image into the dye migration preventive colorable resin layer 12.

Working Example 2

For the preparation of a resin composition for the surface resin layer 1 shown in FIG. 2, FLUONATE K-703 (produced by Dainippon Ink and Chemicals, Inc., weight average molecular weight of 40000, solid content hydroxyl value of 72, containing non-volatile matter of about 60%) was used as a fluorine resin, BURNOCK DN-950 was used as a hardening agent, TINUVIN 900 was used as an ultraviolet absorber, and TINUVIN 292 was used as an antioxidant. The mixture ratio of the resin composition for the surface resin layer 1 in this Working Example 2 was as follows: about 100 parts of FLUONATE K-703, about 25 parts of BURNOCK DN-950, about 1 part of TINUVIN 900 and about 1 part of TINUVIN 292 were used. Then, the afore-mentioned composition was applied on a polyester film to have a dried film thickness of about 20 μm, followed by drying by heating at about 140° C. for about 10 minutes, whereby the surface resin layer 1 was obtained. Following this, on the thus manufactured surface resin layer 1, polycarbonate based non-yellowing type urethane resin NY-331 (produced by Dainippon Ink and Chemicals, Inc., containing nonvolatile matter of about 25%, solvent: DMF, 100% modulus: about 55 kg/cm$^2$) was applied to have a dried film thickness of about 20 μm, followed by drying by heating at about 140° C. for about 10 minutes so as to form a colorable resin layer 2. Following this, on this colorable resin layer 2, a resin composition, in which about 100 parts of vinyl polymer (a-2) that was synthesized according to Reference Example 2 described above, and about 50 parts of BURNOCK DN-950 as a hardening agent were mixed, was applied so as to have a dried film thickness of about 15 μm, followed by drying by heating at about 140° C. for about 10 minutes, whereby a dye migration preventive layer 3 was manufactured. Following this, on this dye migration preventive layer 3, a resin composition, in which about 100 parts of ACRYDIC 49-394-IM as an acrylic resin (produced by Dainippon Ink and Chemicals, Inc., containing nonvolatile matter of about 50%) and about 15 parts of BURNOCK DN-950 were mixed, was applied to have a dried film thickness of about 20 μm, followed by drying by heating at about 140° C. for about 10 minutes, whereby the flexible resin layer 4 was obtained.

On the surface of the flexible resin layer 4 of the thus obtained printing laminate, as shown in FIG. 5, an adhesive layer 5 and a releasing film 6 were formed in a manner similar to Working Example 1 to form a final product.

Next, a printed surface of a transfer paper was applied to the surface resin layer 1 so as to transfer an image into the colorable resin layer 2 in a manner similar to Working Example 1.

Working Example 3

The configuration, the dimensions and the manufacturing method were similar to Working Example 2 except that the mixture liquid of the resin composition for the surface resin layer 1 and the mixture liquid for the colorable resin layer 2 were changed as follows. According to this Working Example, the resin composition for the surface resin layer 1 was mixed for example to include: about 100 parts of FLUONATE K-700 (produced by Dainippon Ink and Chemicals, Inc., weight average molecular weight of 70000, solid content hydroxyl value of 48, containing non-volatile matter of about 50%); about 15 parts of SUMIMAL M-100C. as a hardening agent (methylated melamine resin produced by Sumitomo Chemical Co., Ltd., containing non-volatile matter of 100%); about 1.3 parts of NACURE 3525 as a hardening catalyst (produced by King Industries, Inc., dinonyl naphthalene disulfonic acid); about 1 part of TINUVIN 900 and about 1 part of TINUVIN 292.

The resin composition for the colorable resin layer 2 was mixed for example to include: about 100 parts of BURNOCK D6-439 (alkyd resin produced by Dainippon Ink and Chemicals, Inc., solid content hydroxyl value of 140, containing non-volatile matter of about 80%); and about 82 parts of BURNOCK DN-980 as a hardening agent (polyisocyanate prepolymer produced by Dainippon Ink and Chemicals, Inc., containing non-volatile matter of about 75%).

Working Example 4

The configuration, the dimensions and the manufacturing method were similar to Working Example 2 except that the mixture liquid of the resin composition for the surface resin layer 1 was changed as follows. According to this Working Example, the resin composition for the surface resin layer 1 was mixed for example to include: about 100 parts of ACRYDIC A-9521 (silicon acrylic resin produced by Dainippon Ink and Chemicals, Inc., solid content of 50%) and about 22 parts of ACRYDIC HZ-1018 as a hardening agent (epoxy group containing silicon compound produced by Dainippon Ink and Chemicals, Inc., solid content of 55%).

Working Example 5

The configuration, the dimensions, the manufacturing method and the like were similar to Working Example 2 except that a peelable temporary displaying surface layer capable of displaying by printing was laminated on the printing laminate. On the surface resin layer 1 of the printing laminate manufactured by Working Example 2, FLUONATE FEM-600 produced by Dainippon Ink and Chemicals, Inc., (solid content of 45%) was applied to have a dried film thickness of about 15 μm, followed by drying by heating at about 110° C. for about 5 minutes. Subsequently, MZ-100 produced by Takamatsu Oil & Fat Co., Ltd. as an ink jet accepting agent (amorphous silicon dioxide, a mixture of polyurethane and vinyl resin, solid content of 15%, content of porous pigment in the solid content: about 56%) was applied to have a dried film thickness of about 30 μm, followed by drying by heating at about 110° C. for about 5 minutes. On the thus manufactured temporary displaying surface layer, an image was printed in a manner similar to Working Example 1. After that, a heat treatment was conducted for about 7 minutes using a hot-air drier (by Yamato Scientific Co. Ltd., Fine Oven DF6L) set at about 170° C., whereby the sublimable dye was allowed to sublimate and penetrate, so that the image was printed in the colorable resin layer 2 in the side of the printing laminate. After that, the temporary displaying surface layer in a film state was peeled off.

Working Example 6

As the dye migration preventive layer 3 shown in FIG. 2, on an anneal-treated biaxially stretched polyester film (produced by Teijin DuPont Films Japan Limited, trade name MX534, shrinkage ratio at the time of heating at 150° C. for 30 minutes is 0.3% in the winding direction of the film, film thickness of 97 μm), the resin composition for the colorable resin layer 2, which was mixed similarly to Working Example 2, was applied to have a dried film thickness of about 20 μm, followed by drying by heating at about 140° C. for about 10 minutes, whereby the colorable resin layer 2 was manufactured.

Subsequently, on this colorable resin layer 2, the resin composition for the surface resin layer 1 described in Working Example 2 was applied to have a dried film thickness of about 20 μm, followed by drying by heating at about 140° C. for about 10 minutes, whereby the surface resin layer 1 was obtained. On a rear face of the thus obtained biaxially stretched polyester film that was the dye migration preventive layer of the printing laminate, an adhesive layer 5 and a releasing film 6 was formed in a manner similar to Working Example 1 so as to form a final product. Next, a printed surface of a transfer paper was applied to the surface resin layer 1 in a manner similar to Working Example 1, so as to allow the image to be transferred into the colorable resin layer 2.

Comparative Example 1

The configuration, the dimensions, the manufacturing method and the like were similar to those in Working Example 2 except that the step for the dye migration preventive layer 3 was omitted.

Comparative Example 2

The configuration, the dimensions, the manufacturing method and the like were similar to those in Working Example 2 except that the steps for the dye migration preventive layer 3 and the flexible resin layer 4 were omitted.

Comparative Example 3

The configuration, the dimensions, the manufacturing method and the like were similar to those in Working Example 2 except that the mixture liquid for the resin composition for the surface resin layer 1, the colorable resin layer 2 and the dye migration preventive layer 3 were changed as follows and the step for the flexible resin layer 4 was omitted.

On a supporting film made of a biaxially stretched polyester film, to both sides of which a treatment for facilitating the bonding had been performed (not annealed, used as the dye migration preventive layer 3), a polyurethane resin solution BURNOCK L7-920 (produced by Dainippon Ink and Chemicals, Inc., containing non-volatile matter of about 25±%, solvent: toluene, sec-butanol) was applied to have a dried film thickness of about 20 μm, followed by drying by heating at about 140° C. for about 10 minutes, whereby the colorable resin layer 2 was manufactured. Subsequently, on this colorable resin layer 2, a vinyl chloride resin coating having the following composition was applied to have a dried film thickness of about 20 μm, followed by drying by heating at about 140° C. for 10 minutes, whereby the surface resin layer 1 was formed:

| | |
|---|---|
| (1) vinyl chloride resin | 100 parts |
| (2) ethylene/vinyl ester resin | 25 parts |
| (3) polyester plasticizer | 10 parts |

Note here that NIKAVINYL SG-1100 N (produced by Nippon Carbide Industries Co., Inc.) and Elvaloy (trade name, produced by Du Pont-Mitsui Polychemical Co., Ltd.) respectively were used as the above vinyl chloride resin and ethylene/vinylester resin. As the polyester plasticizer, a material having a number-average molecular weight (Mn) of about 3,000 obtained by synthesizing mixed dihydric alcohol containing propylene glycol, butanediol and hexanediol and adipic acid was used.

The following Tables 2 to 5 summarize the results of the estimation after the image transferring and the examination methods of the above-stated Examples and Comparative Examples.

TABLE 2

| | Ex 1 | Ex 2 | Ex 3 | Ex 4 | Ex 5 | Ex 6 |
|---|---|---|---|---|---|---|
| Property for keeping sharpness of transferred image (A) ★ 1 | ○ | ○ | ○ | ○ | ○ | ○ |
| Property for keeping sharpness of transferred image (B) ★ 2 | ○ | ○ | ○ | ○ | ○ | ○ |
| Property for keeping sharpness of transferred image (C) ★ 3 | ○ | ○ | ○ | ○ | ○ | ○ |
| Erichsen push out test ★ 4 | Δ | ○ | ○ | ○ | ○ | X |
| State of wrinkles subjected to heat vacuum applicator transferring ★ 5 | ○ | ○ | ○ | ○ | ○ | ○ |

TABLE 3

| | Comp. Ex 1 | Comp. Ex 2 | Comp. Ex 3 |
|---|---|---|---|
| Property for keeping sharpness of transferred image (A) ★ 1 | Δ | Δ~X | X |
| Property for keeping sharpness of transferred image (B) ★ 2 | X | X | X |
| Property for keeping sharpness of transferred image (C) ★ 3 | Δ | Δ~X | X |
| Erichsen push out test ★ 4 | ○ | ○ | X |
| State of wrinkles subjected to heat vacuum applicator transferring ★ 5 | ○ | ○ | X |

TABLE 4

| | | | Ex 6 | | | | Comp. Ex 3 | | | |
|---|---|---|---|---|---|---|---|---|---|---|
| | | | cyan | magenta | yellow | black | cyan | magenta | yellow | black |
| accelerated weather-proofness test ★ 6 | Before test | Y | 8.32 | 10.13 | 65.97 | 0.74 | 8.83 | 10.81 | 68.61 | 0.74 |
| | | x | 0.1382 | 0.4845 | 0.4310 | 0.2346 | 0.1421 | 0.5013 | 0.4340 | 0.2481 |
| | | y | 0.1409 | 0.2256 | 0.4953 | 0.2846 | 0.1347 | 0.2358 | 0.4924 | 0.2782 |
| | After test | ΔE | 3.45 | 4.81 | 5.19 | 2.90 | 19.35 | 11.34 | 16.06 | 11.57 |
| | | Appearance | No abnormalities in image, fading hardly was recognized, properties for keeping gloss also were favorable. | | | | Bleeding occurred around the image, fading also was remarkable. Scale of water was attached on the sheet surface, thus degrading the gloss of the sheet surface. | | | |

TABLE 5

| | | | Ex 6 | | | | Comp. Ex 3 | | | |
|---|---|---|---|---|---|---|---|---|---|---|
| | | | cyan | magenta | yellow | black | cyan | magenta | yellow | black |
| outdoor weather proofness test ★ 7 | Before test | Y | 9.21 | 9.23 | 65.79 | 0.76 | 8.79 | 10.74 | 75.64 | 0.78 |
| | | x | 0.1352 | 0.5238 | 0.4316 | 0.2343 | 0.1383 | 0.5359 | 0.4410 | 0.2428 |
| | | y | 0.1350 | o.2429 | 0.4869 | 0.2508 | 0.1284 | 0.2526 | 0.4861 | 0.2717 |
| | After test | ΔE | 5.87 | 9.81 | 3.21 | 7.86 | 40.20 | 22.89 | 17.96 | 21.75 |
| | | Appearance | No abnormalities in image, fading hardly was recognized, properties for keeping gloss also were favorable. | | | | Bleeding occurred significantly around the image, the entire image became blurred and fading occurred considerably. Stains were attached on the sheet surface, thus darkening the sheet. | | | |

(Remarks) The marks ★ 1 to 7 in Tables 2 to 5 are described below as (Remark 1) to (Remark 7).

(Remark 1) 45° facing to the south, atmospheric exposure test (testing location: Wakayama prefecture, Japan), the testing time was one year. ○ (keeping the sharpness)>Δ (slightly bleeding in the image)>x (blurred image and unclear)

(Remark 2) UVCON (Atlas Material Testing Technology LLC, U.S.) accelerated weathering test 1 cycle: UV irradiation at 60° C. for 4 hours/condensation 40° C. for 4 hours testing time: 1,000 hours ○ (keeping the sharpness)>Δ (slightly bleeding in the image)>x (blurred image and unclear)

(Remark 3) Complying with conditions of the sunshine carbon type accelerated weathering test specified by JIS Z 9117. The testing time was 1,000 hours ○ (keeping the sharpness)>Δ (slightly bleeding in the image)>x (blurred image and unclear)

(Remark 4) Erichsen tester (Toyo Seiki Seisaku-sho, LTD.)

Board for attachment: an aluminum plate with thickness of 1 mm and with harness of H24 of A50502P specified by JIS H 4000

Testing method: a printing laminate was attached to the board, which was allowed to stand at room temperature for 48 hours. Subsequently, a punch with radius of 10 mm was pushed against from the rear face of the board, and was pushed therein by 6 mm so as to form a curved surface. Thereafter, the UVCON accelerated weathering test in (Remark 2) was conducted for 1,000 hours.

○: No abnormalities in the appearance;

Δ: cracks occurred at the top of the extruded curved surface; and x: sheet as a whole swelled up from the board (Remark 5) showing the state of a film subjected to the following steps: thermo compression treatment was conducted using a heat vacuum applicator (produced by HUNT EUROPE, VacuSeal 4468) at the degree of vacuum of $3.99\times10^{3}$ Pa (30 mmHg) and at the setting temperature of about 170° C. for about 7 minutes. Thereby, heat was applied to both of the printing laminate and the transfer paper so as to allow the diffusion and the dyeing of the image printed in the transfer paper to diffuse into the printing laminate, thus letting the image to be transferred in the film.

○: No abnormalities in the appearance; and x: Wrinkles occurred in the entire sheet.

(Remark 6) The testing method was the same as in (Remark 3). Chrominance ΔE was measured by photoelectric tristimulus colorimetry specified by JIS Z 8722 and was determined using the color difference formula specified by "JIS Z 8730 chrominance presentation method".

(Remark 7) The testing method was the same as in (Remark 1). Chrominance ΔE was measured similarly to (Remark 6).

As shown in the above Tables 2 to 5, since the flexible resin layer was not formed in Working Example 1, the suitability for the attachment on a three-dimensionally curved surface of this example was not good. However, the property for keeping the sharpness of the image was excellent and the state of the sheet after the heating for transfer also was favorable. Working Examples 2 to 5 were suitable for the attachment on a three-dimensionally curved surface and had an excellent property for keeping sharpness of the image. The state of the sheets of these examples after the heating for transfer also was favorable. As for Working Example 6, the suitability for the attachment on a three-dimensionally curved surface of this example was not good. However, this example used an anneal-treated biaxially stretched polyester film as the dye migration preventive layer, and therefore the property for keeping the sharpness of image was excellent and no wrinkles were found in the sheet after the heating for transfer. Since the dye migration preventive layer 3 was not formed in Comparative Examples 1 and 2, bleeding and the like occurred in the image and the property for keeping the sharpness of the image was poor. Since a biaxially stretched polyester film was used as the dye migration preventive layer of Comparative Example 3, the suitability for the attachment on a three-dimensionally curved surface of this example was not good, and wrinkles occurred in the sheet after the heating for transfer. Furthermore, since a vinyl chloride resin was used as the surface resin layer 1, the property for keeping the sharpness of the image was poor, and the resistance to fading of the image also was poor. Thus, the printing laminate of the present invention, in which the dye migration preventive layer 3 was formed, was free from the occurrence of bleeding and blurs of the image even after it was allowed to stand for a long time and could keep the sharpness of the image, so that the printing laminate having excellent resistance to fading and weather resistance could be realized. Furthermore, in the case where a biaxially stretched polyester was used, the use of an anneal-treated film could prevent the occurrence of wrinkles due to heating. Moreover, by forming the flexible resin layer 4 under the dye migration preventive layer 3, this printing laminate can be applied successfully to the attachment on a curved surface.

INDUSTRIAL APPLICABILITY

According to the present invention, a dye migration preventive colorable resin layer having affinity with a sublimable dye and preventing the migration of the dye is formed as an internal layer. Thereby, a printing laminate that can prevent the migration of the printed sublimable dye, and a printing method and a print using the same can be provided. Furthermore, according to the present invention, a flexible layer having an elongation percentage larger than that of the dye migration preventive colorable resin layer further is provided below the dye migration preventive colorable resin layer. Thereby, a printing laminate having flexibility that enables the attachment on a curved surface of a substrate, and a printing method and a print using the same can be provided.

The invention claimed is:

1. A printing laminate in which a sublimable dye is allowed to penetrate a resin layer by application of heat so as to color the resin layer, comprising:

a surface resin layer (A) that has weak affinity with a sublimable dye and that has a permeability of the dye;

a colorable resin layer (B1) that has affinity with the dye, laminated below the surface resin layer (A); and a dye migration preventive layer (B2) that prevents migration of the dye, laminated below the colorable resin layer (B1), wherein the dye migration preventive layer (B2) is a resin containing as a main component a vinyl resin having a glass transition temperature (Tg) of 70° C. or more and a SP value (Solubility Parameter) of 9.0 or more, a thickness of the dye migration preventive layer (B2) being from 1 μm to 100 μm, and the resin being cross-linked with a hardening substance.

2. The printing laminate according to claim 1, further comprising a flexible resin layer (C) that has an elongation percentage larger than that of the dye migration preventive layer (B2), the flexible resin layer (C) being provided at a further lower layer than the dye migration preventive layer (B2).

3. The printing laminate according to claim 2, further comprising a layer including high refractive glass beads laminated below the flexible resin layer, and a metal reflective layer coated and formed below the layer including the high refractive glass beads, so as to provide a retroreflective layer.

4. The printing laminate according to claim 2, further comprising a layer in which high refractive glass beads are fixed and a focus resin layer, laminated successively below the flexible resin layer (C), and a metal reflective layer further coated and formed below the focus resin layer, so as to provide a retroreflective layer.

5. The printing laminate according to claim 2, wherein, in a retroreflective sheet comprising: a plurality of transparent beads whose lower hemispheres are each provided with a metal reflective layer; a supporting resin sheet supporting the plurality of transparent beads; and a transparent cover film covering the plurality of transparent beads by being disposed on a surface side of the supporting resin sheet, wherein a bonding portion for holding the cover film is provided in the supporting resin sheet, the cover film is the printing laminate.

6. The printing laminate according to claim 1, wherein the dye migration preventive layer (B2) is a layer comprising a three dimensional polymer in which a resin containing as a main component a vinyl resin having a glass transition temperature (Tg) of 70° C. or more and a SP value (Solubility Parameter) of 9.0 or more is cross-linked with a hardening substance.

7. A printing laminate in which a sublimable dye is allowed to penetrate a resin layer by application of heat so as to color the resin layer, comprising:

a surface resin layer (A) that has weak affinity with the sublimable dye and that has a permeability of the dye;

a colorable resin layer (B1) that has affinity with the dye, laminated below the surface resin layer (A); and a dye migration preventive layer (B2) that prevents migration of the dye, laminated below the colorable resin layer wherein the dye migration preventive layer (B2) is a biaxially stretched film that is stretched by 10% or more in a winding direction and in a width direction and that has a shrinkage ratio of 1.0% or less in the winding direction of the film at the time of heating at 150° C. for 30 minutes.

8. The printing laminate according to claim 1 or 7, wherein the surface resin layer (A) is formed of a fluororesin comprising a fluoroolefin copolymer that is soluble in a solvent.

9. The printing laminate according to claim 1 or 7, wherein the surface resin layer (A) is formed of a silicon denatured acrylic resin.

10. The printing laminate according to claim 1 or 7, wherein the colorable resin layer (B1) is a resin containing about 20 weight % or less of a low molecular-weight compound having a molecular weight of about 1,300 or less.

11. The printing laminate according to claim 1 or 7, wherein a matting agent is added to the surface resin layer (A) so as to decrease a 60° gloss of the surface layer to 70 or less.

12. The printing laminate according to claim 1 or 7, wherein at least one layer of the surface resin layer (A) and the colorable resin layer (B1) contains at least one type selected from the group consisting of a high molecular-weight type ultraviolet absorber, a high molecular-weight type hindered amine light stabilizer, and a high molecular-weight type hindered phenol antioxidant.

13. The printing laminate according to claim 1 or 7, wherein light diffusing fine particles are added to at least one layer of the surface resin layer (A), the dye migration preventive layer (B2) and each layer below these layers, so as to assign a light diffusing property to these layers.

14. The printing laminate according to claim 1 or 7, wherein a white pigment is used for at least one layer of the colorable resin layer (B1) and the dye migration preventive layer (B2) so as to form a white Layer, thus enhancing a transmittance density of a printed image.

15. The printing laminate according to claim 1 or 7, further comprising a layer including high refractive glass beads laminated below the dye migration preventive layer (B2), and a metal reflective layer coated and formed below the layer including the high refractive glass beads, so as to provide a retroreflective layer.

16. The printing laminate according to claim 1 or 7, further comprising a layer in which high refractive glass beads are fixed and a focus resin layer, laminated successively below the dye migration preventive layer (B2), and a metal reflective layer further coated and formed below the focus resin layer, so as to provide a retroreflective layer.

17. The printing laminate according to claim 1 or 7, wherein, in a retroreflective sheet comprising: a plurality of transparent beads whose lower hemispheres are each provided with a metal reflective layer; a supporting resin sheet supporting the plurality of transparent beads; and a transparent cover film covering the plurality of transparent beads by being disposed on a surface side of the supporting resin sheet, wherein a bonding portion for holding the cover film is provided in the supporting resin sheet, the cover film is the printing laminate.

18. The printing laminate according to claim 1 or 7, wherein the surface resin layer (A) is coated with a coating formation composition including fine particles made of hydrotalcites and metal oxide, the hydrotalcites being represented by $[M^{2+}_{1-X}M^{3+}_{X}(OH)_2]^{X+}[A^{n-}_{X/n}.mH_2O]^{X-}$, wherein $M^{2+}$ denotes divalent metal ions, $M^{3+}$ denotes trivalent metal ions, $A^{n-}$ denotes anions, $0<X\leqq 0.33$, $0\leqq m\leqq 2$.

19. The printing laminate according to claim 1 or 7, wherein on a rear face of the printing laminate, an adhesive layer further is provided and a releasing member further is provided on an outside of the adhesive layer, and an antistatic treatment is applied to the adhesive layer or the releasing member.

20. The printing laminate according to claim 1 or 7, wherein at least one layer of a peelable temporary displaying layer for enabling printing and displaying further is provided on the surface resin layer (A), and a face of the temporary displaying layer on a side that does not contact with the surface resin layer (A) is capable of absorbing an ink containing a sublimable dye and is capable of allowing the sublimable dye to sublimate by application of heat so as to allow diffusion and dyeing in the printing laminate, and after heating, the temporary displaying layer is capable of being peeled off from the surface resin layer (A) of the printing laminate while keeping a film state.

21. A printing method using the printing laminate according to claim 20, wherein printing is conducted with respect to the temporary displaying layer of the printing laminate using an ink containing a sublimable dye.

22. A printing method using the printing laminate according to claim 20, wherein printing is conducted with respect to the temporary displaying layer of the printing laminate using an ink containing a sublimable dye, and subjecting a heat treatment so as to sublimate the sublimable dye, thus allowing diffusion of the sublimable dye into the colorable resin layer (B1) to dye the same.

23. A printing method by which printing is conducted with respect to a printing laminate in which a sublimable dye is allowed to penetrate a resin layer by application of heat so as to color the resin layer, the printing laminate comprising, a surface resin layer (A) that has weak affinity with the sublimable dye and that has a permeability of the dye; a colorable resin layer (B1) that has affinity with the dye and a dye migration preventive layer (B2) that prevents migration of the dye, which are laminated in this stated order from a surface of the laminate, wherein the dye migration preventive layer (B2) is a resin containing as a main component a vinyl resin having a glass transition temperature (Tg) of 70° C. or more and a SP value of 9.0 or more, a thickness of the dye migration preventive layer (B2) being from 1 μm to 100 μm, and the resin being cross-linked with a hardening substance, the printing method comprising the steps of:

conducting printing with respect to a transfer paper using an ink containing a sublimable dye; and bringing an image formation face of the transfer paper in contact with the surface resin layer (A), followed by a heat treatment so as to sublimate the sublimable dye, thus allowing diffusion of the sublimable dye into the colorable resin layer (B1) to dye the same.

24. The printing method according to claim 23, wherein the printing is conducted by an ink jet method.

25. The printing method according to claim 23, wherein a temperature of the heat treatment is within a range from 150 to 200° C.

26. The printing method according to claim 23, further comprising a step of drying the printed ink, conducted between the printing and the heat treatment.

27. A print with respect to which printing is conducted using a printing laminate in which a sublimable dye is allowed to penetrate a resin layer by application of heat so as to color the resin layer, the printing laminate comprising, a surface resin layer (A) that has weak affinity with the sublimable dye and that has a permeability of the dye; a colorable resin layer (B1) that has affinity with the dye and a dye migration preventive layer (B2) that prevents migration of the dye, which are laminated in this stated order from a surface of the laminate, wherein the dye migration preventive layer (B2) is a resin containing as a main component a vinyl resin having a glass transition temperature (Tg) of 70° C. or more and a SP value of 9.0 or more, a thickness of the dye migration preventive layer (B2) being from 1 μm to 100 μm, and the resin being cross-linked with a hardening substance, wherein the printing is conducted with respect to a transfer paper using an ink containing a sublimable dye; and an image formation face of the transfer paper is brought in contact with the surface resin layer (A), followed by a heat treatment so as to sublimate the sublimable dye, thus allowing diffusion of the sublimable dye into the colorable resin layer (B1) to dye the same.

* * * * *